US010718192B2

(12) United States Patent
Lastiwka

(10) Patent No.: US 10,718,192 B2
(45) Date of Patent: Jul. 21, 2020

(54) SYSTEMS AND METHODS FOR CONTROLLING PRODUCTION OF HYDROCARBONS

(71) Applicant: Suncor Energy Inc., Calgary (CA)

(72) Inventor: Martin Lastiwka, Calgary (CA)

(73) Assignee: Suncor Energy Inc., Calgary, Alberta (CA)

( * ) Notice: Subject to any disclaimer, the term of this patent is extended or adjusted under 35 U.S.C. 154(b) by 336 days.

(21) Appl. No.: 15/252,069

(22) Filed: Aug. 30, 2016

(65) Prior Publication Data

US 2017/0058655 A1 Mar. 2, 2017

(30) Foreign Application Priority Data

Aug. 31, 2015 (CA) ..... 2902548

(51) Int. Cl.
*E21B 43/12* (2006.01)
*E21B 43/24* (2006.01)

(52) U.S. Cl.
CPC ..... *E21B 43/2406* (2013.01); *E21B 43/12* (2013.01)

(58) Field of Classification Search
CPC .. E21B 43/00; E21B 43/12; E21B 43/24–248; E21B 34/06
USPC ..... 166/363, 268, 270.1, 303, 302
See application file for complete search history.

(56) References Cited

U.S. PATENT DOCUMENTS 5,707,214 A * 1/1998 Schmidt ..... E21B 43/123 166/320
5,736,650 A * 4/1998 Hiron ..... E21B 47/10 73/861.04
8,056,627 B2 11/2011 Johnson et al.
8,607,874 B2 12/2013 Schultz et al.
2011/0198097 A1 8/2011 Moen
2012/0298356 A1 11/2012 Sladic et al.
2014/0027126 A1 1/2014 Aakre et al.
2014/0048280 A9 2/2014 Fripp et al.
2014/0216737 A1* 8/2014 Alifano ..... E21B 43/122 166/272.3
2016/0010425 A1* 1/2016 Dyck ..... E21B 34/08 166/380
2016/0376873 A1* 12/2016 Vachon ..... E21B 34/06 703/10

FOREIGN PATENT DOCUMENTS

CA 2578501 C 9/2011
CA 2762480 A1 6/2013
CA 2744835 C 11/2013
CA 2871354 A1 1/2015

OTHER PUBLICATIONS

Stone, T. et al., Advanced Wellbore Simulation of Flow Control Devices With Feedback Control for Thermal Operations, SPE 163594, pp. 1-23 (2013).

* cited by examiner

*Primary Examiner* — George S Gray
(74) *Attorney, Agent, or Firm* — Gowling WLG (Canada) LLP

(57) ABSTRACT

Systems and methods for controlling the inflow of materials into a production well during recovery of hydrocarbons from a hydrocarbon-containing reservoir. The system includes a flow control device configured to limit steam flow and hot water flow from the hydrocarbon-containing reservoir.

23 Claims, 21 Drawing Sheets

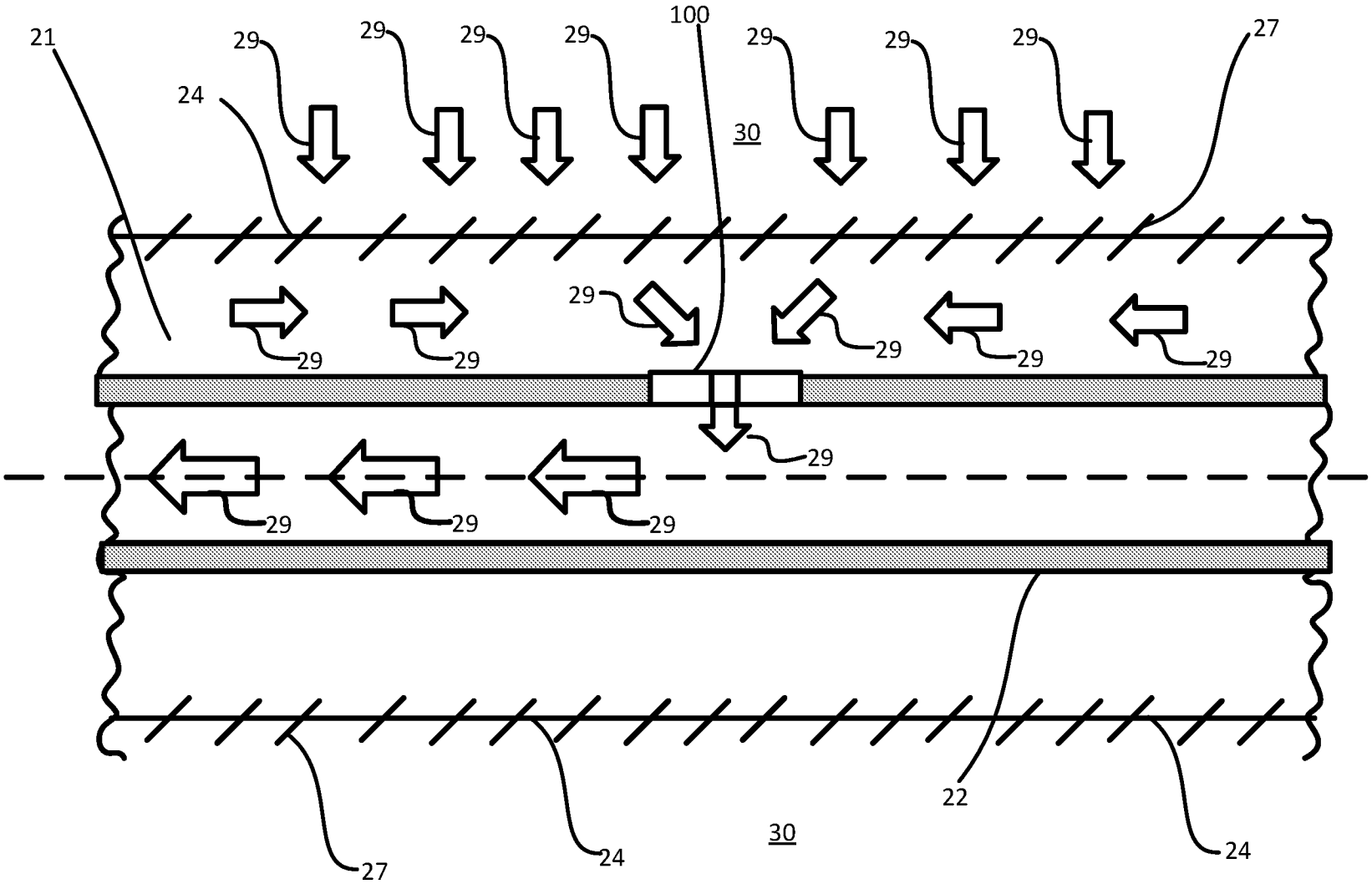
27
29
29
29

SYSTEMS AND METHODS FOR CONTROLLING PRODUCTION OF HYDROCARBONS

CROSS REFERENCE TO RELATED APPLICATION

This is an United States non-provisional patent application claiming priority to, and the benefit of, Canadian Patent Application No. 2,902,548, the entirety of which is incorporated herein by reference.

FIELD

The present disclosures relates to systems and methods for regulating the rate of production of components of fluids from a hydrocarbon-containing reservoir.

Steam-Assisted Gravity Drainage ("SAGD") uses a pair of wells to produce hydrocarbons from a hydrocarbon containing reservoir. Typically the well pair includes two horizontal wells vertically spaced from one another, with the upper well used to inject steam into the reservoir (the "injection well") and the lower well to produce the hydrocarbon (the "production well"). The steam operates to generate a steam chamber in the reservoir, and heat from the steam operates to lower the viscosity of the hydrocarbon, allowing for gravity drainage, and thereby production from the production well. The produced fluids typically include a mixture of hydrocarbons and water, including water formed from the condensing of the steam (referred to as "produced water").

In some cases, however, steam is produced along with the hydrocarbon mixture. In such cases, the injected steam has not been provided with sufficient time and opportunity to supply its heat for purposes of mobilizing the hydrocarbons within the reservoir. Such heat is, therefore, wasted, resulting in less than desirable steam-to-oil ratios. Similar concerns also exist when relatively hot water is produced with the reservoir fluids. In these circumstances, production rate may need to be reduced so as to avoid damaging the liner, pump or other equipment with the incoming steam or hot water that flashes and becomes steam. This can be necessary even if it means that some parts of the well remain cold.

Another concern is with solid particulates which can become entrained within the produced steam. These can contribute to erosion of downhole components used to conduct the produced fluids uphole.

SUMMARY

In one aspect, there is provided a system for the production of fluid from a hydrocarbon-containing reservoir, including: a production conduit for producing fluids from a hydrocarbon-containing reservoir; a flow control device for regulating the flow of fluid from the hydrocarbon-containing reservoir to the production conduit, including: an inlet for receiving fluid from the hydrocarbon-containing reservoir; an upstream fluid passage for conducting the fluid that has been received by the inlet; an axially-aligned fluid passage branch disposed in fluid communication with the production conduit; an angular fluid passage branch disposed in fluid communication with the production conduit; wherein: the upstream fluid passage branches into at least the axially-aligned and angular fluid passage branches at a branching point, and wherein each one of the axially-aligned and angular fluid passage branches, independently, at least in part, extends from the branching point to the production conduit; an axis of the axially-aligned fluid passage branch is disposed at an obtuse angle of greater than 165 degrees relative to an axis of the portion of the upstream fluid passage that is extending to the branching point, and an axis of the angular fluid passage branch is disposed at an angle of between 45 degrees and 135 degrees, relative to the axis of the portion of the upstream fluid passage that is extending to the branching point.

In some implementations, the system wherein the axis, of the portion of the axially-aligned fluid passage branch that is extending from the branching point, is substantially aligned, with the axis of the portion of the upstream fluid passage that is extending to the branching point.

In some implementations, the axis of the portion of the angular fluid passage branch that is extending from the branching point, is disposed substantially orthogonally relative to the axis of the portion of the upstream fluid passage that is extending to the branching point.

In some implementations, the resistance to fluid flow, that the axially-aligned fluid passage branch is configured to provide, is greater than the resistance to fluid flow, that the angular fluid passage branch is configured to provide, by a multiple of at least 1.1.

In some implementations, the length of the axially-aligned fluid passage branch measured along the axis of the axially-aligned fluid passage branch is greater than the length of the angular fluid passage branch measured along the axis of the angular fluid passage branch.

In some implementations, the length of the axially-aligned fluid passage branch measured along the axis of the axially-aligned fluid passage branch is greater than the length of the angular fluid passage branch, measured along the axis of the angular fluid passage branch by a multiple of at least two (2).

In some implementations, the branching of the fluid inlet passage portion into the axially-aligned fluid passage branch and the angular fluid passage branch is defined by a tee fitting.

In some implementations, an injection conduit for supplying a mobilizing fluid for effecting mobilization of hydrocarbons in the hydrocarbon-containing reservoir such that the mobilized hydrocarbons are conducted towards the production conduit.

In some implementations, the injection conduit and the production conduit define a SAGD well pair, such that the injection conduit is disposed within an injection well that is disposed above a production well within which the production conduit is disposed.

In some implementations, the injection conduit and the production conduit are disposed within the same well.

In some implementations, the flow control device further includes a device-traversing fluid passage. The device-traversing fluid passage includes the upstream fluid passage and the axially-aligned fluid passage branch, and is further defined by a constricted passage portion. At least a portion of the constricted passage portion is defined upstream of the branching point, wherein the cross-sectional flow area of the constricted passage portion is less than the cross-sectional flow area of the portion of the device-traversing fluid passage disposed upstream of the constricted passage portion.

In some implementations, the branching point is disposed within the constricted passage portion.

In some implementations, the cross-sectional flow area of a device-traversing fluid passage portion disposed downstream of the constricted passage portion is greater than the cross-sectional flow area of the constricted passage portion.

In some implementations, the axially-aligned fluid passage branch is disposed downstream of the constricted passage portion such that the cross-sectional flow area of the axially-aligned fluid passage branch is greater than the cross-sectional flow area of the constricted passage portion.

In some implementations, the axially-aligned fluid passage branch is disposed downstream of the constricted passage portion such that the cross-sectional flow area of the axially-aligned fluid passage branch is greater than the cross-sectional flow area of the constricted passage portion; and wherein the branching point is disposed downstream of the constricted passage portion such that the branching point is disposed within a device-traversing fluid passage portion having a cross-sectional flow area that is greater than the cross-sectional flow area of the constricted passage portion.

In another aspect, there is provided a system for the production of fluid from a hydrocarbon-containing reservoir, including: a production conduit for producing fluids from a hydrocarbon-containing reservoir; a flow control device for regulating the flow of fluid from the hydrocarbon-containing reservoir to the production conduit, including: an inlet for receiving fluid from the hydrocarbon-containing reservoir; a device-traversing fluid passage extending from the inlet to the production conduit, including: an upstream fluid passage for conducting the fluid that has been received by the inlet; an axially-aligned fluid passage branch disposed in fluid communication with the production conduit; an angular fluid passage branch disposed in fluid communication with the production conduit; a constricted passage portion having a cross-sectional area that is less than a cross-sectional flow area are upstream of the constricted passage portion; wherein: the upstream fluid passage portion branches into at least the axially-aligned and angular fluid passage branches at a branching point, and wherein each one of the axially-aligned and angular fluid passage branches, independently, at least in part, extends from the branching point to the production conduit; an axis of the fluid passage branch that is extending from the branching point is disposed at an obtuse angle of greater than 165 degrees relative to an axis of the portion of the upstream fluid passage that is extending to the branching point, an axis of the portion of the angular fluid passage branch is disposed at an angle of between 45 degrees and 135 degrees, relative to the axis of the portion of the upstream fluid passage that is extending to the branching point; and at least a portion of the constricted passage portion is defined upstream of the branching point.

In some implementations, the branching point is disposed within the constricted passage portion.

In some implementations, a cross-sectional flow area of the device-traversing fluid passage portion, that is disposed downstream of the constricted passage portion, is greater than the cross-sectional flow area of the constricted passage portion.

In some implementations, the axially-aligned fluid passage branch is disposed downstream of the constricted passage portion such that the cross-sectional flow area of the axially-aligned fluid passage branch is greater than the cross-sectional flow area of the constricted passage portion.

In some implementations, the axially-aligned fluid passage branch is disposed downstream of the constricted passage portion such that the cross-sectional flow area of the axially-aligned fluid passage branch is greater than the cross-sectional flow area of the constricted passage portion; and wherein the branching point is disposed downstream of the constricted passage portion such that the branching point is disposed within a device-traversing fluid passage portion having a cross-sectional flow area that is greater than the cross-sectional flow area of the constricted passage portion.

In some implementations, the axis, of the portion of the axially-aligned fluid passage branch that is extending from the branching point, is substantially aligned with the axis of the portion of the upstream fluid passage that is extending to the branching point.

In some implementations, the axis, of the portion of the angular fluid passage branch that is extending from the branching point, is disposed substantially orthogonally relative to the axis of the portion of the upstream fluid passage that is extending to the branching point.

In some implementations, the branching of the fluid inlet passage portion into the axially-aligned fluid passage branch and the angular fluid passage branch is defined by a tee fitting.

In some implementations, an injection conduit for supplying a mobilizing fluid for effecting mobilization of hydrocarbons such that the mobilized hydrocarbons are conducted towards the production conduit.

In some implementations, the injection conduit and the production conduit define a SAGD well pair, such that the injection conduit is disposed within an injection well above a production well within which the production conduit is disposed.

In some implementations, the injection conduit and the production conduit are disposed within the same well.

In another aspect, there is provided a method of producing heavy oil from a hydrocarbon-containing reservoir, including: providing an injection conduit and a production conduit within the hydrocarbon-containing reservoir; providing a flow control device for regulating the flow of fluid from the hydrocarbon-containing reservoir to the production conduit, the flow control device including: an inlet for receiving fluid from the hydrocarbon-containing reservoir; an upstream fluid passage for conducting fluid that has been received by the inlet from the hydrocarbon-containing reservoir; an axially-aligned fluid passage branch disposed in fluid communication with the production conduit; an angular fluid passage branch disposed in fluid communication with the production conduit; wherein: the upstream fluid passage branches into at least the axially-aligned and angular fluid passage branches at a branching point; an axis of the axially-aligned fluid passage branch is disposed at an obtuse angle of greater than 165 degrees relative to an axis of the portion of the upstream fluid passage that is extending to the branching point, and an axis of the angular fluid passage branch is disposed at an angle of between 45 degrees and 135 degrees, relative to the axis of the portion of the upstream fluid passage that is extending to the branching point, injecting steam into the reservoir via the injection conduit such that mobilized bitumen is generated; and such that: (a) a reservoir fluid mixture, including heavy oil and condensed steam, is produced through the production conduit and is conducted through the production conduit upstream of the fluid flow control device; (b) steam is conducted through the branching point of the fluid flow control device to generate a Venturi effect; and in response to the Venturi effect, inducing flow of at least a fraction of the produced reservoir fluid mixture from the production conduit and through the angular fluid passage branch to the branching point for admixing with at least a fraction of the steam such that an admixture flow is generated and conducted through the axially-aligned fluid passage branch; and recovering at least the heavy oil from the production well.

In another aspect, there is provided a system for the production of fluid from a hydrocarbon-containing reservoir, including: a production conduit for producing fluids from a hydrocarbon-containing reservoir; a flow control device for regulating the flow of fluid from the hydrocarbon-containing reservoir to the production well, including: an inlet for receiving fluid from the hydrocarbon-containing reservoir; an upstream fluid conducting passage for conducting the fluid received by the inlet; a flow dampening chamber; a fluid connector passage branch effecting fluid communication between the upstream fluid conducting passage and the flow dampening chamber; a production conduit-connecting passage branch extending to the production conduit, and effecting fluid communication between the upstream fluid conducting passage and the production conduit; wherein: the upstream fluid-conducting passage branches into at least the fluid connector passage branch and the production conduit-connecting passage branch at a downstream branching point; an axis of fluid connector passage branch is disposed at an obtuse angle of greater than 165 degrees relative to the axis of the portion of the upstream fluid conducting passage that is extending to the branching point; and an axis of the production conduit-connecting passage branch is disposed at an angle of between 45 degrees and 135 degrees relative to the axis of the portion of the upstream fluid conducting passage that is extending to the downstream branching point;

In some implementations, the axis of the portion of the fluid connector passage branch that is extending from the downstream branching point, is disposed in substantial alignment with the axis of the portion of the upstream fluid conducting passage that is extending to the downstream branching point; and wherein the axis, of the portion of the well-connecting passage branch that is extending from the downstream branching point, is disposed substantially orthogonally relative to the axis of the portion of the upstream fluid conducting passage that is extending to the downstream branching point.

In some implementations, the flow dampening chamber includes a dimension, extending along the axis of the portion of the fluid connector passage branch that is extending from the branching point, equivalent to at least one (1) diameter of the upstream fluid conducting passage.

In some implementations, the flow dampening chamber includes a diameter that is equivalent to at least one (1) diameter of the upstream fluid conducting passage.

In another aspect, there is provided a method of producing bitumen from a hydrocarbon-containing reservoir, including: providing an injection conduit and a production conduit within the hydrocarbon-containing reservoir; providing a flow control device for regulating the flow of fluid from the hydrocarbon-containing reservoir to the production conduit, the flow control device including: an inlet for receiving fluid from the hydrocarbon-containing reservoir; an upstream fluid conducting passage for conducting the fluid received by the inlet; a flow dampening chamber; a fluid connector passage branch effecting fluid communication between the upstream fluid conducting passage and the flow dampening chamber; a production conduit-connecting passage branch extending to the production conduit, and effecting fluid communication between the upstream fluid-conducting passage and the production conduit; wherein: the upstream fluid-conducting passage branches into at least the fluid connector passage branch and the production conduit-connecting passage branch at a downstream branching point; an axis of fluid connector passage branch is disposed at an obtuse angle of greater than 165 degrees relative to the an axis of the portion of the upstream fluid conducting passage that is extending to the branching point; and an axis of the production conduit-connecting passage branch is disposed at an angle of between 45 degrees and 135 degrees relative to the axis of the portion of the upstream fluid conducting passage that is extending to the downstream branching point; injecting steam into the reservoir such that a reservoir fluid mixture is generated and introduced to the upstream fluid conducting passage of the flow control device; conducting at least steam of the introduced reservoir fluid mixture to the flow dampening chamber, via the upstream fluid conducting passage, so as to effect a reduction in the kinetic energy of the steam; and conducting the dampened steam to the production conduit through the production conduit-connecting passage branch.

In some implementations, the axis of a portion of the fluid connector passage branch that is extending from the downstream branching point, is disposed in substantial alignment with the axis of the portion of the upstream fluid conducting passage that is extending to the downstream branching point; and wherein the axis of the portion of the production conduit-connecting passage branch that is extending from the downstream branching point is disposed substantially orthogonally relative to the axis of the portion of the upstream fluid conducting passage that is extending to the downstream branching point.

In some implementations, the conducted reservoir fluid mixture fraction includes solid particulate and the solid particulate is entrained with the steam that is conducted to the flow dampening chamber.

In another aspect, there is provided a system for the production of fluid from a hydrocarbon-containing reservoir, including: a production conduit for producing fluids from a hydrocarbon-containing reservoir; a flow control device for regulating the flow of fluid from the hydrocarbon-containing reservoir to the production conduit, including: an inlet for receiving reservoir fluid from the hydrocarbon-containing reservoir; a device-traversing fluid passage extending from the inlet to the production conduit, for conducting the received reservoir fluid, the device-traversing fluid passage including: an upstream fluid conducting passage; a downstream fluid conducting passage; wherein at least a portion of the downstream fluid conducting passage has a cross-sectional flow area that is greater than the cross-sectional flow area of the upstream fluid passage.

In some implementations, the entirety of the downstream fluid conducting passage has a cross-sectional flow area that is greater than the cross-sectional flow area of the upstream fluid conducting passage.

In some implementations, the device-traversing fluid passage consists of the upstream fluid conducting passage and the downstream fluid conducting passage.

In another aspect, there is provided a method of producing heavy oil from an oil sands reservoir, including: injecting steam into the reservoir such that heavy oil is mobilized, and a reservoir fluid mixture, including heavy oil and condensed hot water, is generated; conducting the reservoir fluid mixture through a constricted passage such that the hot water of the reservoir fluid mixture is accelerated, resulting in a concomitant pressure decrease sufficient to effect vaporization of at least a fraction of the hot water; conducting the vaporized water through a fluid passage having a relatively larger cross-sectional flow area than the constricted fluid passage and to the production conduit; and recovering at least the heavy oil from the production conduit.

In another aspect, there is provided a system for the production of fluid from a hydrocarbon-containing reservoir, including: a production conduit for producing fluids from a hydrocarbon-containing reservoir; a flow control device for regulating the flow of fluid from the hydrocarbon-containing reservoir to the production conduit, including: an inlet for receiving fluid from the hydrocarbon-containing reservoir; a device-traversing fluid passage extending from the inlet to the production conduit, including: an axially-aligned branching fluid passage for conducting the fluid that has been received by the inlet; an axially-aligned fluid passage branch disposed in fluid communication with the production conduit; a constricted passage portion; an angular fluid passage branch disposed in fluid communication with the production conduit; wherein: the axially-aligned branching fluid passage branches into at least the axially-aligned and angular fluid passage branches at a first branching point, and wherein each one of the axially-aligned and angular fluid passage branches, independently, at least in part, extends from the first branching point to the production conduit; relative to the angular fluid passage branch, the axially-aligned fluid passage branch is configured to provide greater resistance to fluid flow; the axially-aligned fluid passage branch has a cross-sectional flow area that is greater than the cross-sectional flow area of the portion of the device-traversing fluid passage that is disposed upstream of the axially-aligned fluid passage; an axis of a portion of the axially-aligned fluid passage branch is disposed at an obtuse angle of greater than 165 degrees relative to an axis of the portion of the axially-aligned branching fluid passage that is extending to the first branching point; an axis of the angular fluid passage branch is disposed at an angle of between 45 degrees and 135 degrees, relative to the axis of the portion of the axially-aligned branching fluid passage that is extending to the first branching point; and at least a portion of the constricted passage portion is defined upstream of the first branching point, wherein the cross-sectional flow area of the constricted passage portion is less than the cross-sectional flow area of a device-traversing fluid passage portion that is disposed upstream of the constricted passage portion; a flow dampening chamber; wherein: the axially-aligned fluid passage branch includes: a downstream branching fluid passage that branches at a second branching point into: a fluid connector passage branch that extends into the flow dampening chamber; and a production conduit-connecting passage branch that extends into the production conduit; wherein: an axis of the fluid connector passage branch is disposed at an obtuse angle of greater than 165 degrees relative to an axis of a portion of the downstream branching fluid passage that is extending to the second branching point, and an axis of the production conduit-connecting passage branch is disposed at an angle of between 45 degrees and 135 degrees relative to the axis of the portion of the downstream branching fluid passage that is extending to the second branching point.

In one aspect, there is provided a flow control device for regulating the flow of fluid from a hydrocarbon-containing reservoir to a production conduit, the flow control device configured for fluid communication with the production conduit. The flow control device includes an inlet for receiving reservoir fluid from the hydrocarbon-containing reservoir and communicating fluidly with a first fluid conducting passage; the first fluid conducting passage having a first cross-sectional diameter, the first cross-sectional diameter being substantially constant along the first fluid conducting passage; a second fluid conducting passage for communicating fluidly with the first fluid conducting passage and having a second cross-sectional diameter, the second cross-sectional diameter being substantially constant along the second fluid conducting passage and greater than the first cross-sectional diameter at a defined ratio; and the second fluid conducting passage having a length that is proportional to the first cross-sectional diameter.

In some implementations, the defined ratio is 3:1. In some implementation, the defined ratio is 2:1. In some implementations, the length of the second fluid conducting passage is at least 10× greater than the first cross-sectional diameter. In some implementations, the length of the second fluid conducting passage is 20× to 50× greater than the first cross-sectional diameter.

In some implementations, the flow control device includes a transition passage connecting the first fluid conducting passage at one end and the second fluid conducting passage at the other end, the one end of the transition passage having substantially the same cross-sectional flow area as that of the first fluid conducting passage and the other end of the transition passage having substantially the same cross-sectional flow area as that of the second fluid conducting passage.

In some implementations, the transition passage extends from the one end to the other end at an angle of 1.5 degrees relative to the flow control device's central longitudinal axis. In some implementations, the transition passage extends from the one end to the other end at an angle between 0.5 degrees and 30 degrees relative to the flow control device's central longitudinal axis. In some implementations, the transition passage extends from the one end to the other end smoothly.

In some implementations, the first fluid conducting passage transitions to the second fluid conducting passage in a step change.

In some implementations, the flow control device includes a curved entry passage positioned between the inlet and the first fluid conducting passage. In some implementations, the curved entry passage includes a smooth surface extending from the inlet to the first fluid conducting passage.

In some implementations, the first cross-sectional diameter is 3 mm. In some implementations, the first cross-sectional diameter ranges between 2 mm to 5 mm. In some implementations, the second cross-sectional diameter is 6 mm. In some implementations, the first fluid conducting passage has a cross-section diameter that is between 1 mm and 7 mm. In some implementations, the first fluid conducting passage has a cross-sectional diameter of at least 15 mm. In some implementations, the second cross-sectional diameter is 9 mm. In some implementations, the first fluid conducting passage has a length ranging from 7 mm to 10 mm.

In some implementations, the production conduit is configured for steam assisted gravity drainage operation.

In one aspect, there is provided a system for the production of fluid from a hydrocarbon-containing reservoir. The system includes a production conduit for producing fluids from a hydrocarbon-containing reservoir using steam assisted gravity drainage; and a flow control device for regulating the flow of fluid from the hydrocarbon-containing reservoir to the production conduit, the flow control device in fluid communication with the production conduit. The flow control device includes an inlet for receiving reservoir fluid from the hydrocarbon-containing reservoir and communicating fluidly with a first fluid conducting passage; the first fluid conducting passage having a first cross-sectional diameter, the first cross-sectional diameter being substantially constant along the first fluid conducting passage and at least 3 mm; a second fluid conducting passage in fluid communication with the first fluid conducting passage and having a second cross-sectional diameter, the second cross-sectional diameter being substantially constant along the second fluid conducting passage and greater than the first cross-sectional diameter at a defined ratio that is at least 3:1; the second fluid conducting passage having a length that is at least 20× the first cross-sectional diameter; and a curved entry passage positioned between the inlet and the first fluid conducting passage.

In one aspect, there is provided a method of producing heavy oil from an oil sands reservoir. The method includes the steps of injecting a fluid into the reservoir such that heavy oil is mobilized, and a reservoir fluid mixture, including heavy oil and condensed hot water, is generated; conducting the reservoir fluid mixture through a first fluid conducting passage such that the hot water of the reservoir fluid mixture is accelerated, resulting in a concomitant pressure decrease sufficient to effect vaporization of at least a fraction of the hot water, the first fluid conducting passage having a first cross-sectional diameter and the first cross-sectional diameter being substantially constant along the first fluid conducting passage; conducting the vaporized water through a second fluid conducting passage and to the production conduit, the second fluid conducting passage having a second cross-sectional diameter, the second cross-sectional diameter being substantially constant along the second fluid conducting passage and greater than the first cross-sectional diameter at a defined ratio, and the second fluid conducting passage having a length that is proportional to the first cross-sectional diameter; and recovering at least the heavy oil from the production conduit.

In some implementations, the defined ratio is 3:1. In some implementations, the defined ratio is 2:1. In some implementations, the length of the second fluid conducting passage is at least 10× greater than the first cross-sectional diameter. In some implementations, the length of the second fluid conducting passage is 20× to 50× greater than the first cross-sectional diameter.

In some implementations, the flow control device includes a transition passage connecting the first fluid conducting passage at one end and the second fluid conducting passage at the other end, the one end of the transition passage having substantially the same cross-sectional flow area as that of the first fluid conducting passage and the other end of the transition passage having substantially the same cross-sectional flow area as that of the second fluid conducting passage. In some implementations, the transition passage extends from the one end to the other end at an angle of 1.5 degrees relative to the flow control device's central longitudinal axis. In some implementations, the transition passage extends from the one end to the other end at an angle between 0.5 degrees and 30 degrees relative to the flow control device's central longitudinal axis. In some implementations, the transition passage extends from the one end to the other end smoothly.

In some implementations, the first fluid conducting passage transitions to the second fluid conducting passage in a step change.

In some implementations, the flow control device includes a curved entry passage positioned between the inlet and the first fluid conducting passage. In some implementations, the curved entry passage includes a smooth surface extending from the inlet to the first fluid conducting passage.

In some implementations, the first cross-sectional diameter is 3 mm. In some implementations, the first cross-sectional diameter ranges between 2 mm to 5 mm. In some implementations, the second cross-sectional diameter is 6 mm. In some implementations, the second cross-sectional diameter is 9 mm.

In some implementations, the method is used in steam assisted gravity drainage operation. In some implementations, the fluid is steam.

In another aspect, there is provided a method of producing heavy oil from an oil sands reservoir. The method includes the steps of: injecting steam into the reservoir such that heavy oil is mobilized, and a reservoir fluid mixture, including heavy oil and condensed hot water, is generated; conducting the reservoir fluid mixture through a first fluid conducting passage, such that the hot water of the reservoir fluid mixture is accelerated, resulting in a concomitant pressure decrease sufficient to effect vaporization of at least a fraction of the hot water, the first fluid conducting passage having a first cross-sectional diameter and the first cross-sectional diameter being substantially constant along the first fluid conducting passage and at least 3 mm; conducting the vaporized water through a second fluid conducting passage and to the production conduit, the second fluid conducting passage having a second cross-sectional diameter, the second cross-sectional diameter being substantially constant along the second fluid conducting passage and greater than the first cross-sectional diameter at a defined ratio that is at least 3:1, and the second fluid conducting passage having a length that is at least 20× the first cross-sectional diameter; and recovering at least the heavy oil from the production conduit.

BRIEF DESCRIPTION OF DRAWINGS

Implementations of the invention will now be described with the following accompanying drawings, in which:

FIG. 2A is a schematic illustration of an interval of a production well, with a flow control device installed in production tubing, with a sand control feature disposed between the reservoir and the production tubing, and showing material flows during the production phase of a SAGD operation;

DETAILED DESCRIPTION

Figure 1:
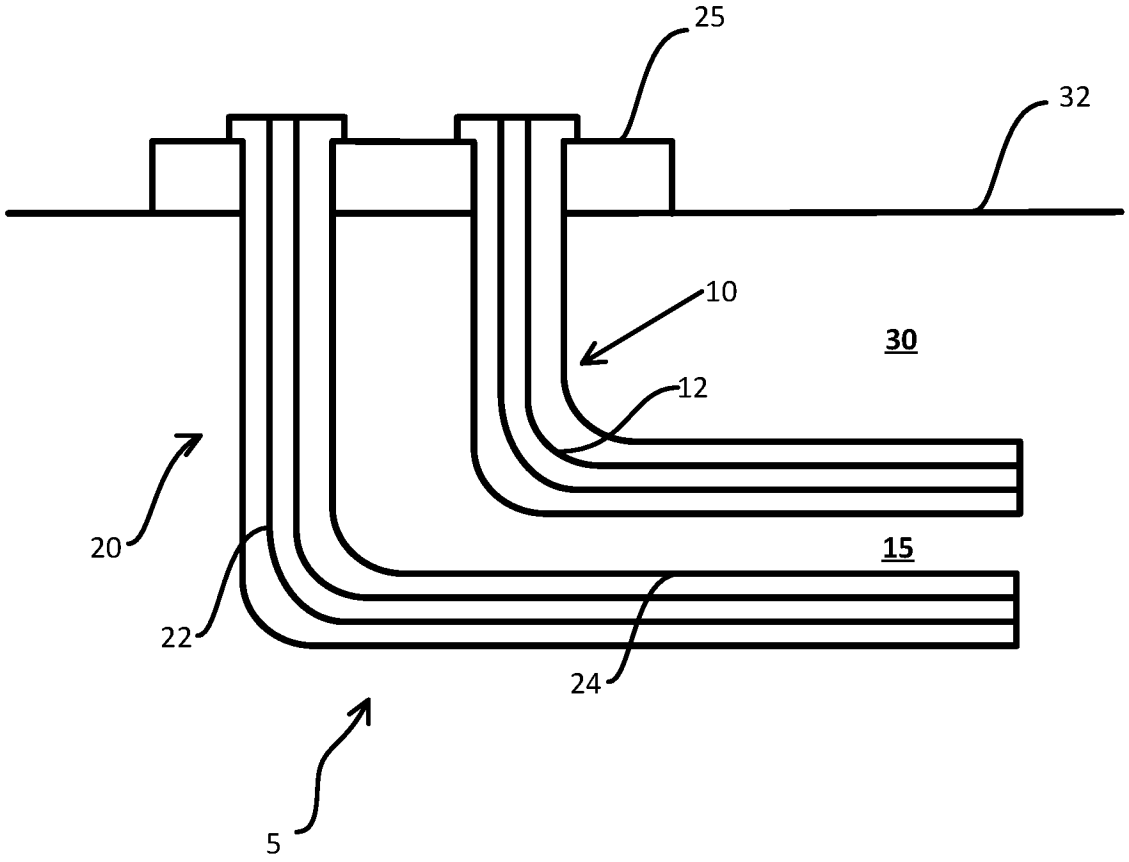
FIG. 1 is a schematic illustration of a well pair in an oil sands reservoir for implementation of a steam-assisted gravity drainage process.

Referring to FIG. 1, there is provided a system 5 for producing bitumen from a hydrocarbon-containing reservoir 30, such as an oil sands reservoir 30.

For illustrative purposes below, an oil sands reservoir from which bitumen is being produced using Steam-Assisted Gravity Drainage ("SAGD") is described. However, it should be understood, that the techniques described could be used in other types of hydrocarbon containing reservoirs and/or with other types of enhanced recovery methods that use other fluids, in place of steam, that incur phase change as part of the production system.

A reservoir fluid-comprising mixture is produced from an oil sands reservoir using a SAGD well pair. Referring to FIG. 1, in a typical SAGD well pair, the wells are spaced vertically from one another, such as wells 10 and 20, and the vertically higher well, i.e., well 10, is used for steam injection in a SAGD operation, and the lower well, i.e., well 20, is used for producing bitumen. During the SAGD operation, steam injected through the well 10 (typically referred to as the "injection well") is conducted into the reservoir 30. The injected steam mobilizes the bitumen within the oil sands reservoir 30. The mobilized bitumen and steam condensate drains through the interwell region 15 by gravity to the well 20 (typically referred to as the "production well"), collects in the well 20, and is surfaced through tubing or by artificial lift to the surface 32, where it is produced through a wellhead 25.

In some implementations, for example, the SAGD operation can be conducted using a single well within which are disposed separate conduits (e.g., tubing) for effecting the injection and the production.

In the implementation shown, a cased-hole completion is provided, and includes a casing run into both of the injection and production wells 10, 20. The casing can be cemented to the oil sands reservoir for effecting zonal isolation. A liner can be hung from the last section of casing. The liner can be made from the same material as the casing, but, unlike the casing, the liner does not extend back to the wellhead. The liner is slotted or perforated to effect fluid communication with the oil sands reservoir. In some implementations, the liner can be run to the wellhead.

Fluid conducting tubing 22 (or multiple tubing strings) can be installed within the casing of the injection well 10. The fluid conducting tubing 22 is provided for injecting steam into the oil sands reservoir 30.

Fluid conducting tubing (or multiple tubing strings) can also be installed within the casing of the production well 20. The fluid conducting tubing or "production conduit 22", is provided for conducting fluid, including bitumen, that has been received from the oil sands reservoir 30, to the surface 32, thereby effecting production of bitumen.

During the production phase of the SAGD operation, steam is injected into the well 10 via the injection conduit 22, and conducted through a liner 24, of the production well 20 into the oil sands reservoir 30. The injected steam mobilizes the bitumen within the oil sands reservoir 30. The mobilized bitumen and steam condensate drains through the interwell region, by gravity to the production well 10, through the liner 24, and is then conducted through the production conduit 22 to the surface 32. Artificial lift can be used to help conduct the fluids received within the production conduit 22 to the surface 32.

In some cases, uncondensed steam can also be conducted to the production well 20. This is undesirable, as the uncondensed steam represents wasted heat energy. Because the steam has not condensed, this means that heat energy of the injected steam has not been used, as originally intended, for mobilizing and promoting the production of bitumen. In these circumstances, and amongst other things, production rate may need to be reduced so as to avoid damaging the liner, pump or other equipment with the incoming steam or hot water that flashes and becomes steam. This can be necessary even if it means that some parts of the well remain cold. An additional concern with produced steam is that solid particulates can be entrained with the incoming uncondensed steam, and their introduction can lead to premature erosion of fluid conducting components of the production well 20.

In some cases, limiting production rate at a location within the well where hotter water is being produced can assist in achieving temperature uniformity (or conformance) as oil production can accelerate at other locations.

In this respect, a flow control device 100 is provided for regulating the flow of fluid being conducted from the oil sands reservoir 30 to the surface 32 via a well. Amongst other things, the flow control device 100 is provided for interfering with the mass flow rate, of a flowing gas (or gas-liquid mixture) relative to a liquids-only fluid for a given pressure differential across the device 100, or conversely, creating a greater pressure differential for gases (or gas-liquids) relative to liquids-only fluids for a given mass flow rate. The device 100 is especially effective when a phase change (liquid-to-gas) is possible under flowing conditions. In some implementations, for example, the gas includes steam.

Figure 2:
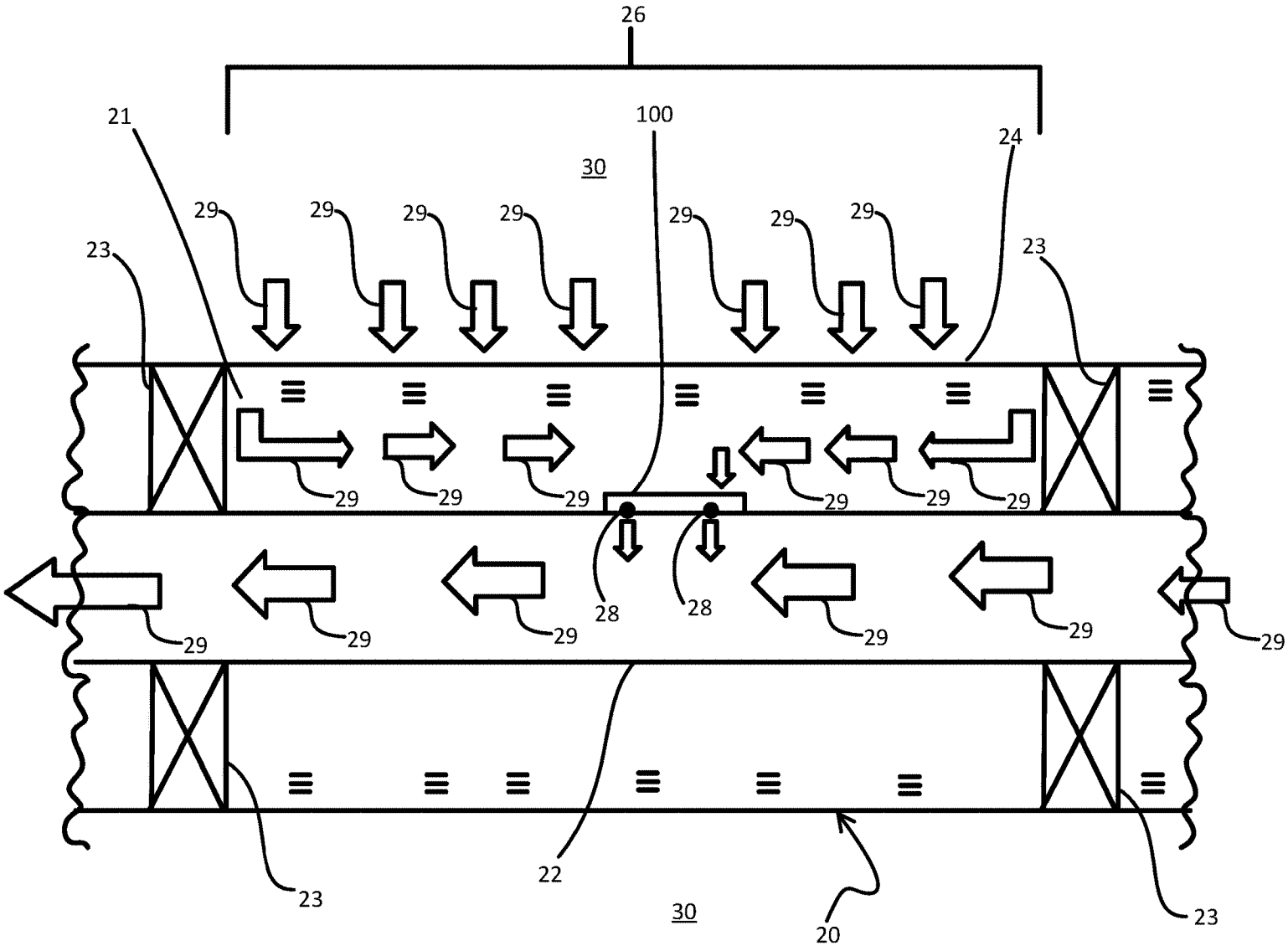
FIG. 2 is a schematic illustration of an interval of a production well, with a flow control device installed in production tubing, and showing material flows during the production phase of a SAGD operation.

Steam content of the fluid being conducted into the production conduit 22 varies over time, and is based on, amongst other things, conditions within the reservoir. As well, at any given time, the steam content of fluid being conducted over the entire length of the production conduit 22 can vary from section to section. The flow control device 100 is configured to interfere with the flow of steam, or hot water at or near saturation conditions, from the reservoir 30 to the production conduit 22, and this regulatory function is triggered while steam is being conducted from the reservoir 30 to the production well 20. Referring to FIG. 2, in the system 5, while only 1 flow control device is shown, system 5 can include multiple flow control devices 100 and the multiple flow control device 100 can provide this regulatory function over multiple intervals 26 of the production well 20. The flow control device 100 is installed in ports 28 of the production conduit 22, and are thereby disposed in fluid communication with the flow passage within the production conduit 22. The flow control device is positioned within the annulus 21 between the production conduit 22 and the slotted liner 24, and is configured to receive fluids conducted from the oil sands reservoir 30 and through the slotted liner 24. Multiple intervals 26 are isolated with, and defined between, spaced-apart packers 23 within the annulus 21 and extending between the production conduit 22 and the liner 24. In some implementations, for example, for each of these intervals 26, fluid communication is effected with the production conduit 22 through two ports 28 provided in the production conduit 22, each one of these ports 28 having four flow control devices 100 installed within them. The flow paths of the fluids being produced from the reservoir 30 are indicated by reference numeral 29. Referring to FIG. 2A, alternatively, the flow control devices 100 can be built into the liner, and such flow control devices can include some form of sand control 27 disposed along the producing portion of the production conduit 22, between the flow control device 100 and the reservoir 30. In some implementations, for example, the devices 100 are built into a tubular portion, which is placed inside of a slotted liner or other type of sand screen. The flow area between the sand control and the devices 100 would be isolated in sections along the well 20, such that flow from the sections would be directed towards certain devices 100 only. This allows the distribution of fluid production to be controlled (to a certain extent), and limits the impact of any low-subcool/saturated liquids, or even gas phases present, to that section where such fluids enter the well 20.

The flow control device 100, its various aspects and its various implementations, will now be described.

The flow control device 100 can include an inlet 102 for receiving fluid from the oil sands reservoir 30. The fluid can include hydrocarbons, including bitumen, steam condensate and, in some cases, uncondensed steam. In some implementations, where another fluid is used instead of steam, the fluid can include fluid condensates and, in some cases, uncondensed fluid. The flow control device 100 is configured to selectively interfere with the flow of steam, received by the inlet 102, from the oil sands reservoir 30 to the production conduit 22.

Figure 3:
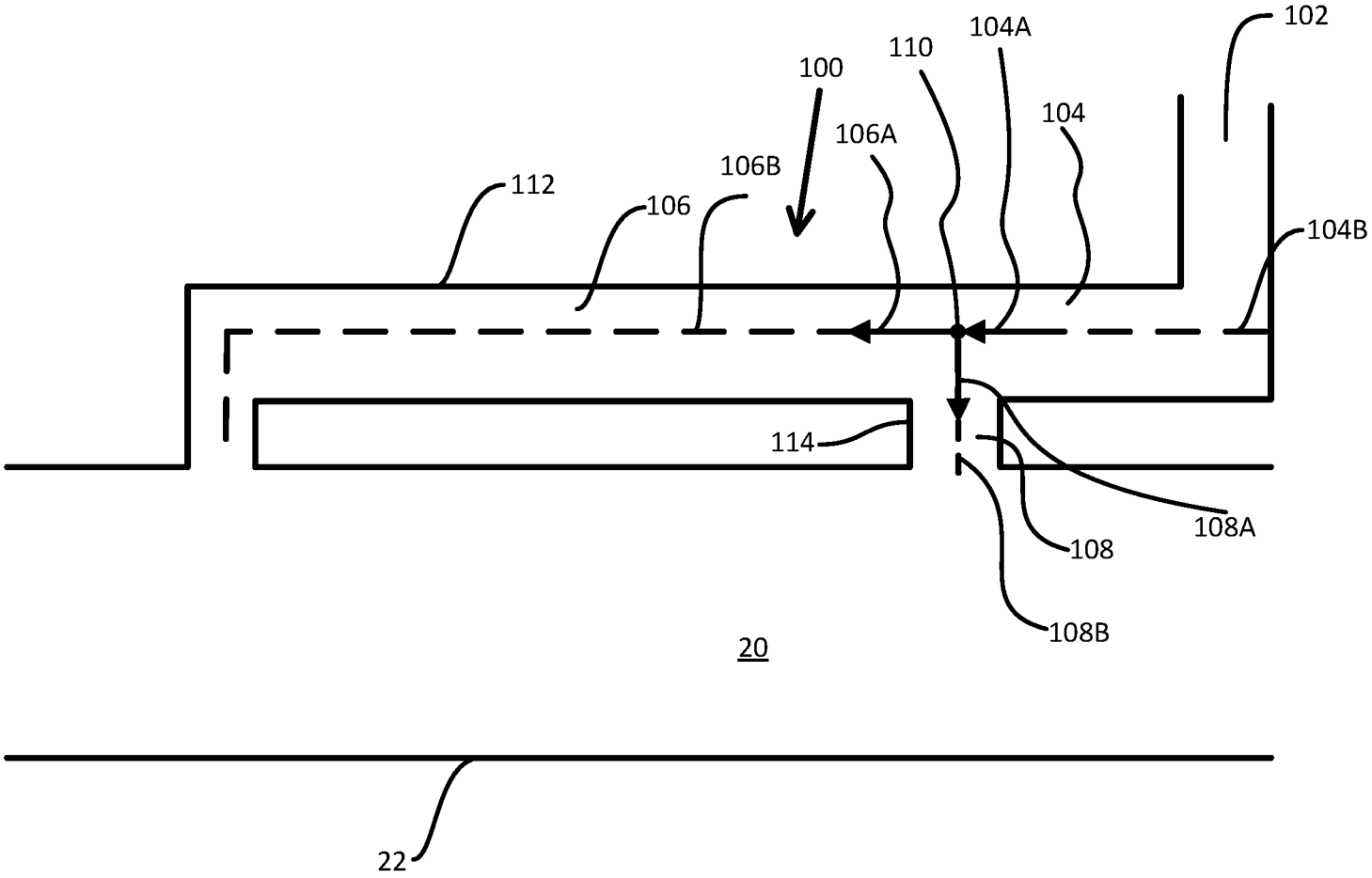
FIG. 3 is a schematic illustration showing an implementation of a flow control device installed in fluid communication with production tubing.
Figure 4:
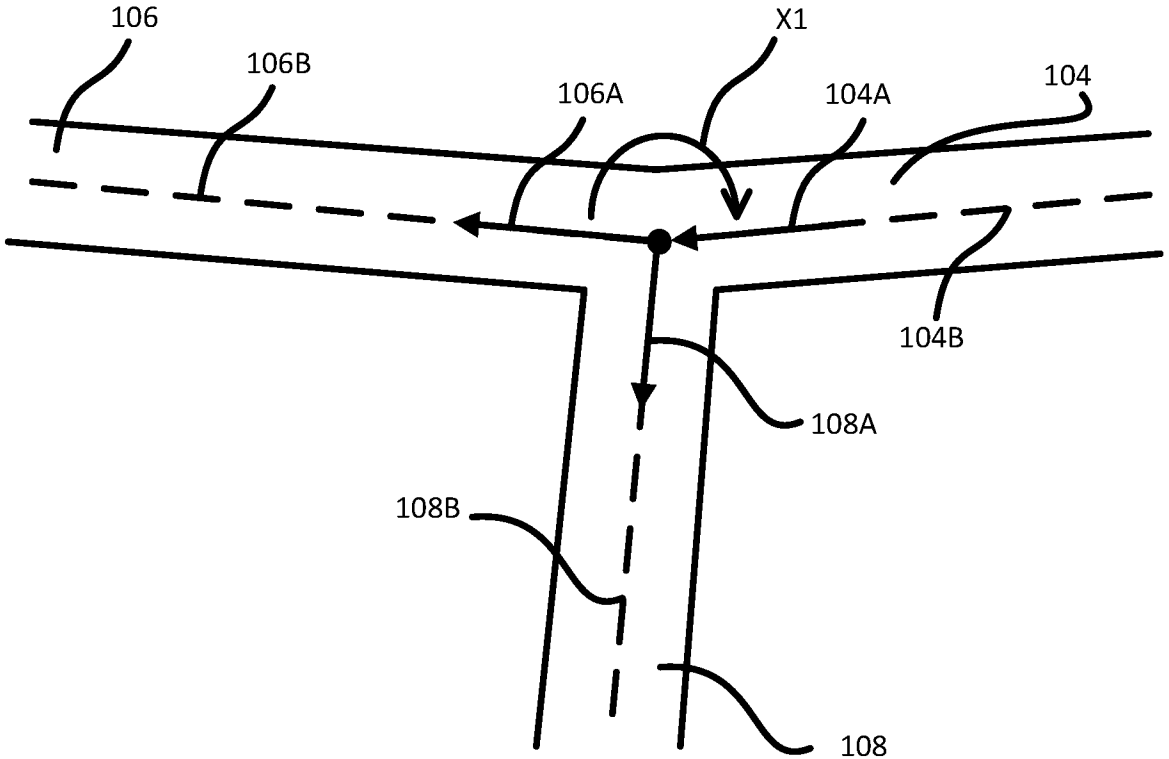
FIG. 4 is a schematic illustration of a portion of an alternative implementation of the flow control device illustrated in FIG. 3, as installed in fluid communication with production tubing, showing the fluid passage branches extending from the branching point in different orientations relative to the implementation illustrated in FIG. 3.

In one aspect, and referring to FIGS. 3 and 4, the flow control device 100 includes an upstream fluid passage 104 for conducting the fluid that has been received by the inlet 102, and the upstream fluid passage 104 portion branches into at least an axially-aligned fluid passage branch 106 (which is axially aligned with the longitudinal axis of inlet 102) and an angular fluid passage branch 108 (which is at an angle relative to the longitudinal axis of the inlet 102) at a branching point 110. In some implementations, the axially-aligned fluid passage branch 106 is substantially aligned axially with the longitudinal axis of inlet 102. "Axially-aligned" as used in this disclosure includes substantial alignment with an axis. Each one of the axially-aligned and angular fluid passage branches 106, 108, independently, at least in part, extends from the branching point 110 to the production tubing, and is configured to conduct fluid from the branching point 110 to the production conduit 22. In the illustrated implementation, each one of the axially-aligned and angular fluid passage branches 106, 108, independently, extends from the branching point 110 to the production conduit 22.

The angular fluid passage branch 108 is disposed at a substantial angle (for example, greater than 45 degrees) from the axis of the nozzle such that higher-Reynolds number flows bypass this path, while lower Reynolds number flows change direction and pass through it. In some implementations, for example, the flow path within angular fluid passage branch 108 is reduced in length relative to the axially-aligned fluid passage branch 106. The reduced total flow path length through this angular fluid passage branch 108 leads to a reduced pressure drop. When configured for given operating conditions, higher-velocity gases and liquids entrained therein would bypass this exit and incur the pressure drop associated with the primary exit and full path length of the device 100, while higher-viscosity and lower-velocity fluids (e.g. single-phase liquids) would make use, at least partially, of the angular fluid passage branch 108. In this way, subcooled liquids would incur less pressure drop relative to gas-liquid mixtures or gas-only fluids.

In this respect, the ray 106A that is extending from the branching point 110: (a) along the axis 106B of the portion of the axially-aligned fluid passage branch 106 that is extending from the branching point 110, and (b) in the direction in which at least a fraction of the fluid, that has been received by the inlet from the hydrocarbon-containing reservoir, and which the axially-aligned fluid passage branch 106 is configured to conduct towards the production conduit 22, is being conducted within the axially-aligned fluid passage branch 106 when the fluid is being received by the inlet, is disposed at an obtuse angle "X1" of greater than 165 degrees (including 180 degrees) relative to the ray 104A, that is extending to the branching point 110: (a) along the axis 104B of the portion of the upstream fluid passage 104 that is extending from the branching point 110, and (b) in the direction in which the fluid, that has been received from the hydrocarbon-containing reservoir by the inlet, and which the upstream fluid passage 104 is configured to conduct towards the production conduit 22, is being conducted within the upstream fluid passage 104 when the fluid is received by the inlet.

In some of these implementations, for example, the axis 106B, of the portion of the axially-aligned fluid passage branch 106 that is extending from the branching point, is aligned, or substantially aligned, with the axis 104B of the portion of the upstream fluid passage 104 that is extending to the branching point 110.

The axis 108A, of the portion of the angular fluid passage branch 108 that is extending from the branching point 110, is disposed at an angle of between 45 degrees and 135 degrees, relative to the axis 104A of the portion of the upstream fluid passage 104 that is extending to the branching point 110. In some of these implementations, for example, the axis, of the portion of the angular fluid passage branch that is extending from the branching point, is disposed orthogonally, or substantially orthogonally, relative to the axis of the portion of the upstream fluid passage that is extending to the branching point.

By configuring the relative orientation of the fluid passages 104, 106, 108 in this manner, where the fluid being conducted within the upstream fluid passage 104 includes steam, and when the fluid reaches the branching point 110, the steam, by virtue of its momentum and relatively low viscosity, has a tendency to remain flowing in the same or substantially the same direction. This means that the steam (and also any hydrocarbons, such as bitumen, that can be entrained within the steam) has a tendency to continue flowing into the axially-aligned fluid passage branch 106, rather than changing direction to enter the angular fluid passage branch 108. In contrast, liquid fluids being conducted through the upstream fluid passage 104, such as those including hydrocarbons such as bitumen, are flowing at lower rates and are, typically, characterized with higher viscosities. As a result, the flow of the liquid fluid is more likely to be diverted into the angular fluid passage branch 108.

The flow control device 100 is further configured such that, relative to the angular fluid passage branch 108, the axially-aligned fluid passage branch 106 is configured to provide greater resistance to fluid flow. In this respect, because the steam is conducted through the axially-aligned fluid passage branch 106 (as explained above), the steam is subjected to greater interference to flow. In this respect, resistance to the flow of steam from the oil sands reservoir 30 and into the production conduit 22, is effected by the flow control device 100.

In some implementations, for example, the resistance to fluid flow, which the axially-aligned fluid passage branch is configured to provide, is greater than the resistance to fluid flow, which the angular fluid passage branch is configured to provide, by a multiple of at least 1.1, such as at least 1.3, or such as at least 1.5.

In some implementations, for example, the length of the axially-aligned fluid passage branch 104, measured along the axis 106B of the axially-aligned fluid passage branch 106, is greater than the length of the angular fluid passage branch 108, measured along the axis 108B of the angular fluid passage branch. In some of these implementations, for example, the length of the axially-aligned fluid passage branch 106, measured along the axis 106B of the axially-aligned fluid passage branch, is greater than the length of the angular fluid passage branch 108, measured along the axis 108B of the angular fluid passage branch, by a multiple of at least two (2), such as at least three (3), or such as at least four (4), or such as at least five (5).

Figure 5:
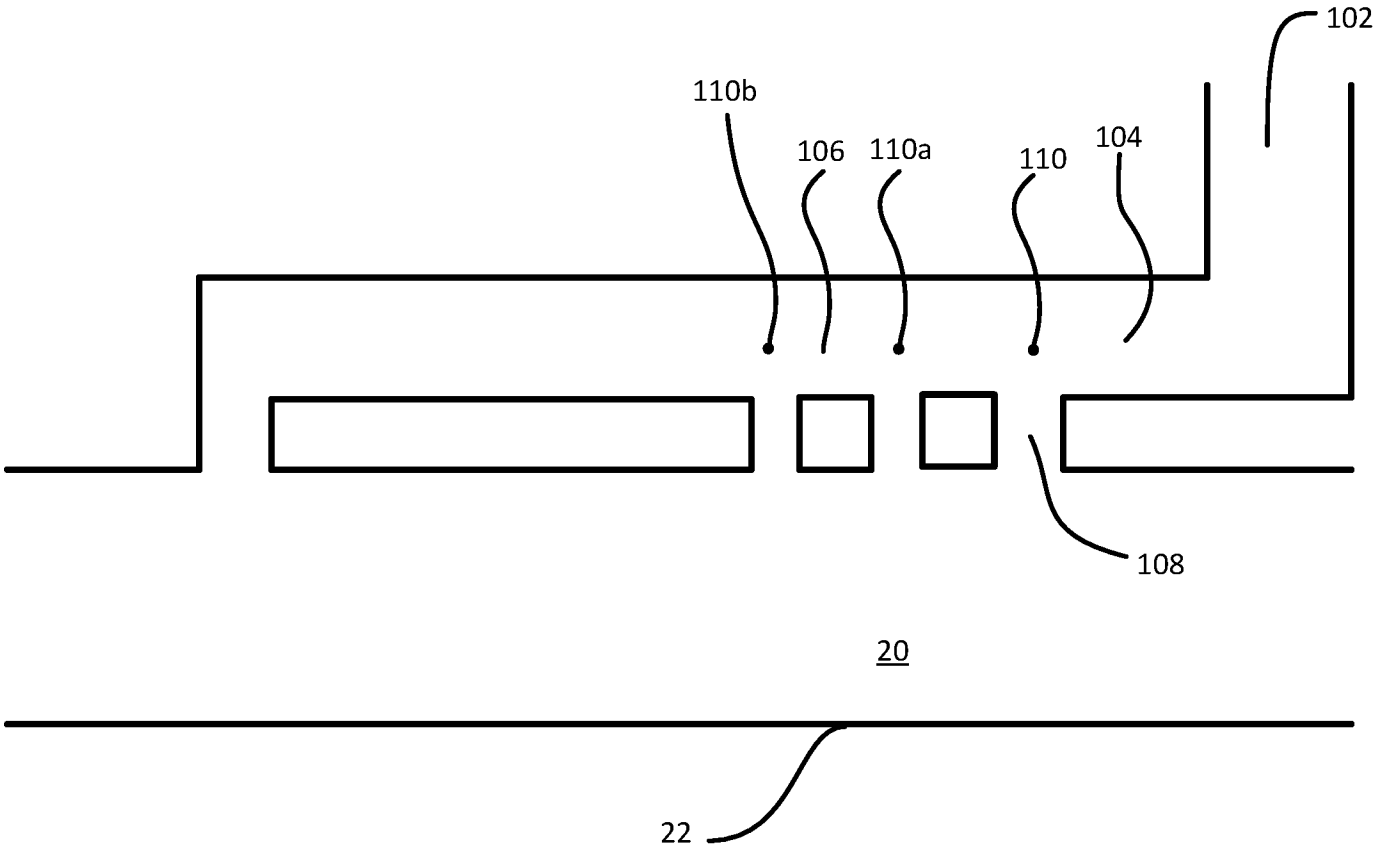
FIG. 5 is a schematic illustration of another alternative implementation of the flow control device illustrated in FIG. 3, as installed in fluid communication with production tubing, showing multiple branching points.

In some implementations, for example, additional branching points 110*a*, 110*b* can be disposed downstream of the branching point 110, and within the axially-aligned fluid passage branch 106, for receiving fluid from a preceding branching point upstream, as illustrated in FIG. 5. Such additional branching points 110*a*, 110*b* are configured, similarly to the branching point 110, to branch into fluid passages having relative orientations as those described above. Such additional branching points 110*a*, 110*b* can provide for a more robust design, being tolerant to different flow parameters of the fluid received by the upstream fluid passage. In this respect, in some operational implementations, for example, liquid can be carried over with steam that enters the fluid passage 106, in cases where the liquid is characterized by one or more of relatively low viscosity, relatively high velocity, or relatively high density.

In some implementations, for example, the branching of the upstream fluid passage portion 104 into the axially-aligned fluid passage branch 100 and the angular fluid passage branch 108 is defined by a tee fitting. In some implementations, for example, the upstream fluid passage 104 extends from the inlet 102 to the branching point 110, such that the inlet 102 defines the inlet of the upstream fluid passage 104.

In a related aspect, a method is provided of producing bitumen from an oil sands reservoir 30, the method including providing a SAGD well pair 10, 20 and the above-described flow control device 100. In one implementation, steam is injected into an interwell region 15 between the injection well 110 and the production well 20 such that a first admixture, including bitumen, liquid water, and steam, is generated; and such that at least a fraction of the first admixture is received by the inlet 102 of the flow control device 100. Flow of the received first admixture is conducted by the inlet fluid passage 104 and is then distributed between at least the axially-aligned fluid passage 106 and angular fluid passage branches 108 within the flow control device 100. In this respect, the steam tends to flow through the axially-aligned fluid passage branch 106, and liquid fluids, including hydrocarbons, such as bitumen, tend to flow through the angular fluid passage branch 106.

In another aspect, the angular fluid passage branch 108 can operate as an inlet into the device 110 when the pressure near or in the nozzle is lower than the pressure downstream of the device within the production conduit 22. This effect occurs when fluid velocities through the nozzle reach a certain threshold, creating a favourable pressure gradient. The influx of additional fluid in from the secondary outlet will lead to a greater flow rate (and as a consequence pressure drop) through the primary path and outlet.

Figure 6:
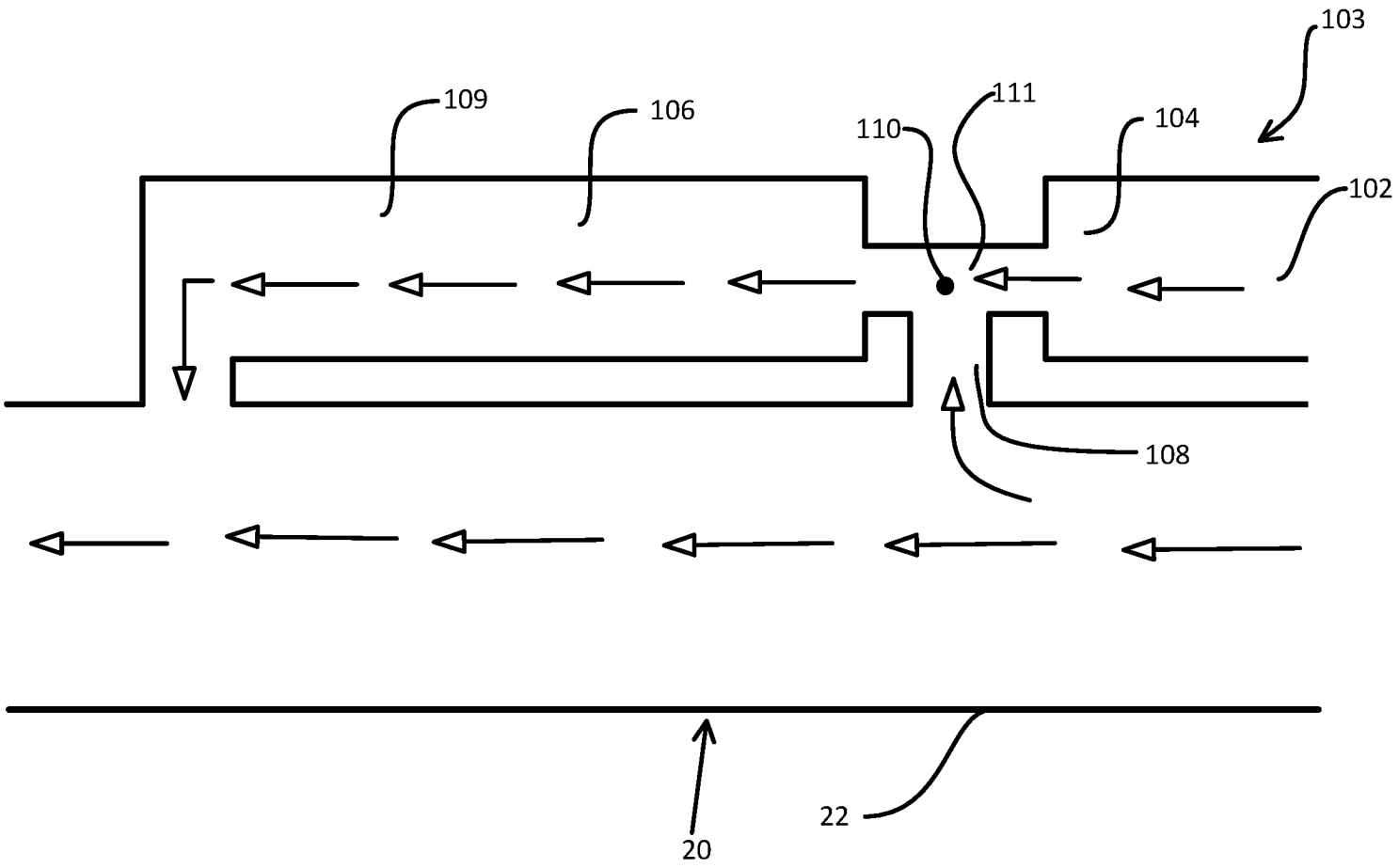
FIG. 6 is a schematic illustration of another implementation of a flow control device installed in fluid communication with production tubing, and showing material flows during an operational implementation of the system.
Figure 7:
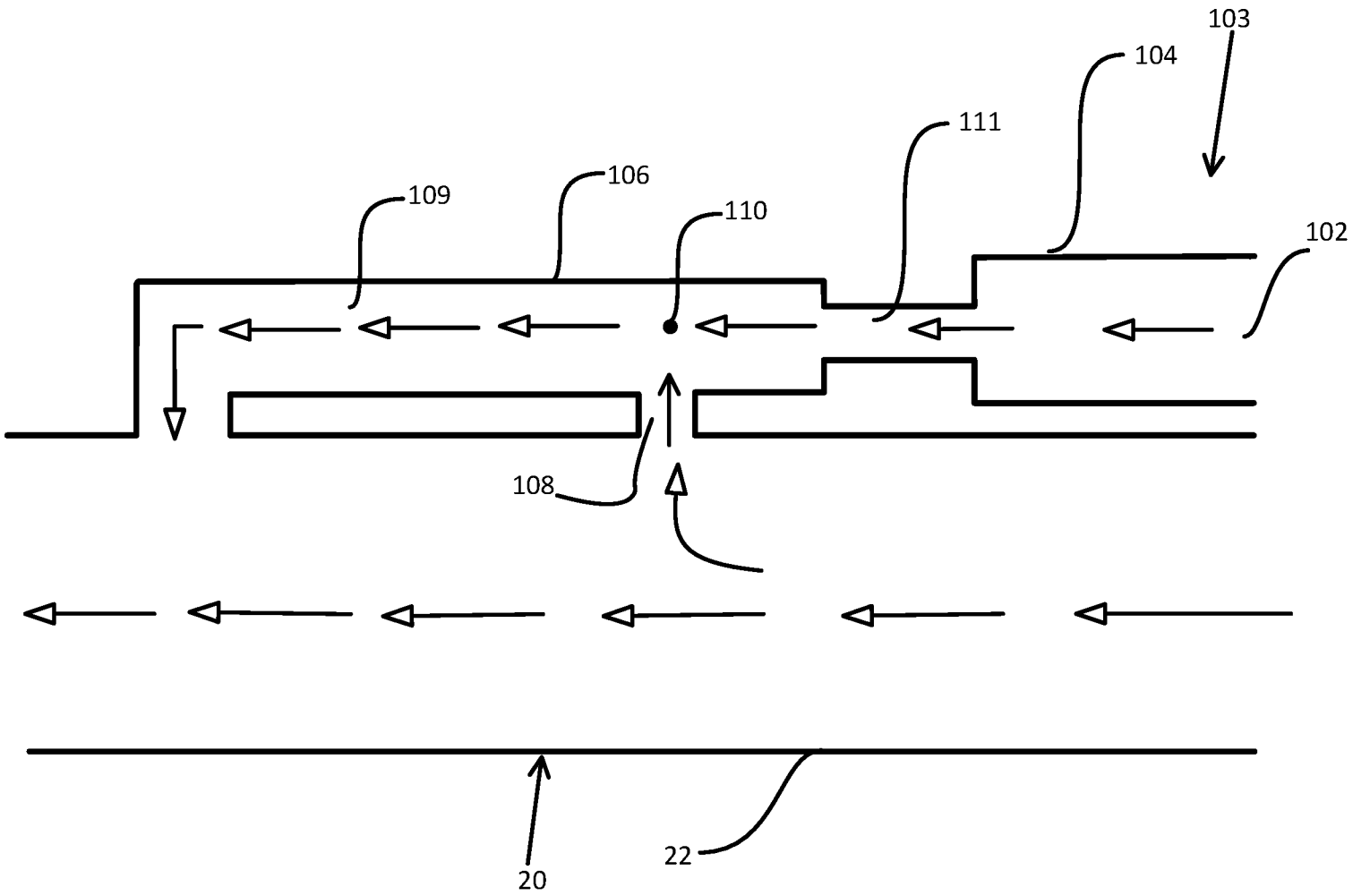
FIG. 7 is a schematic illustration of an alternative implementation of the flow control device illustrated in FIG. 6, as installed in fluid communication with production tubing, showing the branching point disposed downstream from the constricted passage portion.
Figure 8:
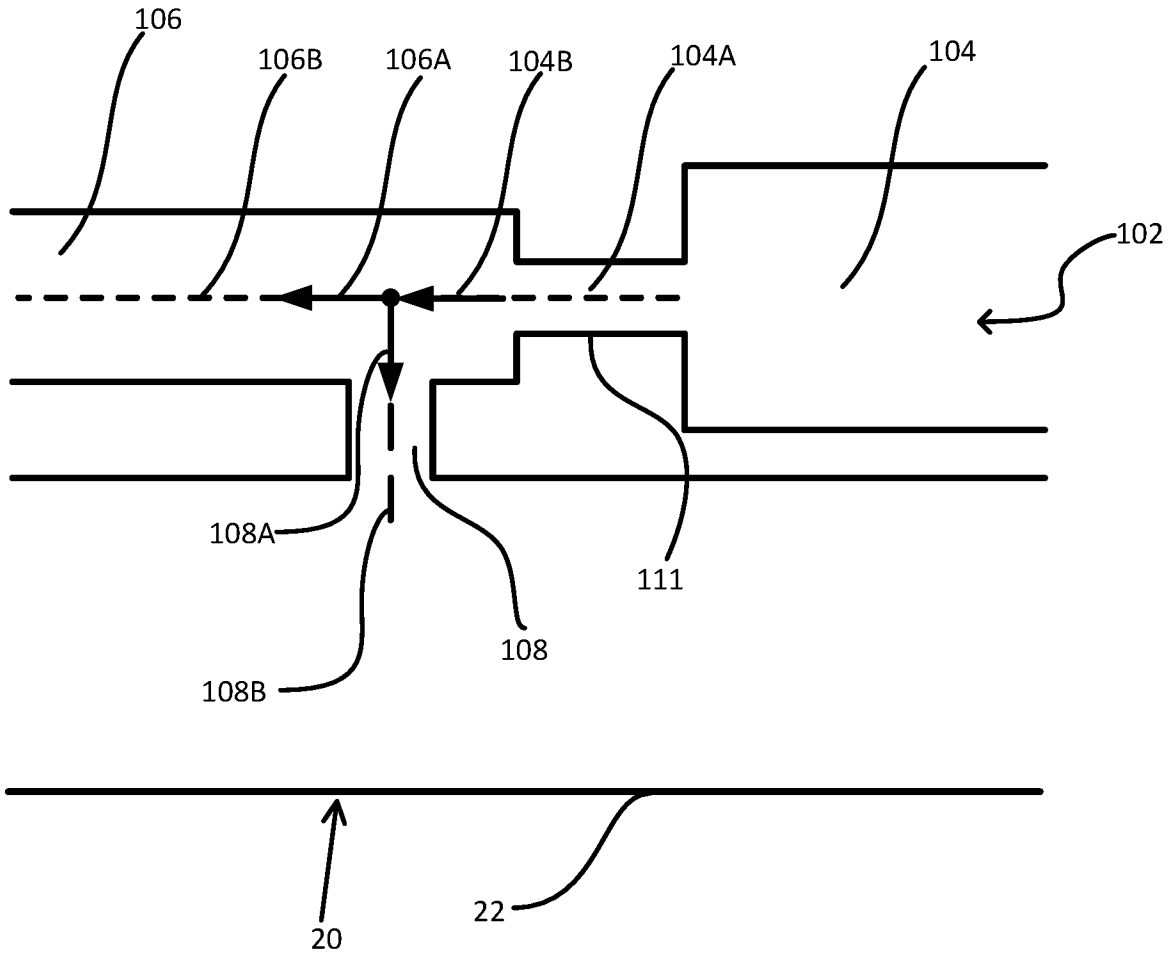
FIG. 8 is a detailed view of a portion of the implementation of the flow control device illustrated in FIG. 7, showing the fluid passages branches extending from the branching point.

In this respect, and referring to FIGS. 6 to 8, the flow control device 100 can, in some operational implementations, be used with the effect that reservoir fluid being produced downhole from the flow control device 100, and being conducted uphole by the production conduit 22, is induced to mix with any steam that can be flowing through the branching point 110, in response to the Venturi effect. As used herein, the term "Venturi effect" includes acceleration induced pressure drop. Under upset conditions, uncondensed steam (or hot water that has flashed to steam) could be flowing through the branching point 110, and this configuration of the flow control device 100, and its relationship to the production conduit 22 further mitigates the risk of having the steam entering the production conduit 22 under these circumstances. Because the produced fluid, being induced to admix with the steam in response to the Venturi effect, is relatively cooler than the steam, the admixing effects cooling of the steam, which, ultimately, increases the flow path length and, therefore, the pressure drop associated with producing fluids with steam, thereby interfering with steam production, which could have resulted if the steam was conducted to the production conduit 22 at a hotter temperature.

Under some operating conditions: (a) a reservoir fluid mixture is produced through the production well 20 and is conducted through the production well 20 upstream of the flow control device 100; and (b) steam is conducted across the branching point 110 to generate a Venturi effect.

Because of the above-described relative orientations of the fluid passages 104, 106, 108, and because steam (either uncondensed steam that has entered the flow control device 100 or hot water that has entered the flow control device and flashed within the passage 104) is being conducted within the upstream fluid passage 104, when the steam reaches the branching point 100, the steam, by virtue of its momentum and relatively low viscosity, has a tendency to remain flowing in the same or substantially the same direction. This means that the steam has a tendency to continue flowing into the axially-aligned fluid passage branch 106, rather than changing direction to enter the angular fluid passage branch 108. The flowing steam generates a suction pressure at the branching point 100, inducing flow of the produced fluid, being conducted through the production conduit 22, via the angular fluid passage branch 108, to the branching point 100, such that the steam is admixed with the produced fluid, resulting in cooling of the steam, and the admixture is conducted downstream through the axially-aligned fluid passage branch 106.

The fluid passages 104, 106 are co-operatively configured so as to enable the steam being conducted through the branching point to generate the Venturi effect. In this respect, the upstream fluid passage 104 (upstream of the branching point 110) has a cross-sectional flow area that is greater than the cross-sectional flow area of a connecting fluid passage (a "constricted passage portion 111") which joins the upstream fluid passage 104 to the axially-aligned fluid passage branch 106. By flowing steam from the upstream fluid passage 104 (having a wider cross-section) through the narrower cross-sectional flow area of the connecting fluid passage, the pressure of the steam decreases and, concomitantly, the steam is accelerated. By virtue of the pressure decrease, a suction pressure is generated at the branching point 110 which is sufficient to induce flow of the produced fluid through the angular fluid passage branch 108 and into the branching point 110. The produced fluid is admixed with the steam to produce an admixture which is then conducted from the branching point 110 and to the axially-aligned fluid passage branch 106.

In this respect, and again referring to FIGS. 6 and 8, in some implementations, for example, the flow control device 100 further includes a Venturi effect-inducing fluid passage 103. The Venturi effect-inducing fluid passage 103 includes the upstream fluid passage 104 and the axially-aligned fluid passage branch 106, and is further defined by the constricted passage portion 111, wherein at least a portion of the constricted passage portion 111 is disposed upstream of the branching point 110. The cross-sectional flow area of the constricted passage portion 111 is less than the cross-sectional flow area of the portion 109 of the device-traversing fluid passage 105 that is disposed upstream of the constricted passage portion 111.

In some implementations, for example, the cross-sectional flow area of the portion 109 of the Venturi effect-inducing fluid passage 103, that is disposed downstream of the constricted passage portion 111, is greater than the cross-sectional flow area of the constricted passage portion 111. In such implementations, for example, as the admixture is conducted through the wider cross-sectional flow area of the portion 109 of the device-traversing fluid passage 105 that is disposed downstream of the constricted passage portion (the "downstream fluid passage 109"), the admixture decelerates, and, concomitantly, increases in pressure. Without configuring such portion 109 of the Venturi effect-inducing fluid passage 103 to have a cross-sectional flow area that is greater than the cross-sectional flow area of the constricted fluid passage 111, fluid flow through the downstream fluid passage 109 would be relatively higher and experience higher pressure drop due to frictional losses. As such, a greater fraction of the available pressure would be dedicated to overcoming these frictional losses, resulting in a relatively higher pressure at the branching point 110, and thereby reducing the driving force available for the Venturi effect and, consequently, the ability to induce fluid from the production well to admix with steam at the branching point 110.

With respect to those implementations where the cross-sectional flow area of the downstream fluid passage 109 is greater than the cross-sectional flow area of the constricted passage portion 111, in some of these implementations, for example, the branching point 110 is disposed within the constricted passage portion 111, such that the axially-aligned fluid passage branch 106 is disposed downstream of the constricted passage portion 111 (see FIG. 6). As a consequence, the cross-sectional flow area of the axially-aligned fluid passage branch 106 is greater than the cross-sectional flow area of the constricted passage portion 111.

Also, with respect to those implementations, where the cross-sectional flow area of the downstream fluid passage 109 is greater than the cross-sectional flow area of the constricted passage portion 111, in some of these implementations, for example, and, referring to FIG. 7, the branching point 110 is disposed downstream of the constricted passage portion 111 (and, as a necessary incident, as is the axially-aligned fluid passage branch 106). As a consequence, the branching point 110 is disposed within a portion of the Venturi effect-inducing fluid passage 103 (i.e., the downstream fluid passage 109) having a cross-sectional flow area that is greater than the cross-sectional flow area of the constricted passage portion 111 (and also, as a necessary incident, the axially-aligned fluid passage branch 106 has a cross-sectional flow area that is greater than the cross-sectional flow area of the constricted passage portion 111).

In another aspect, the flow control device 100 is configured to reduce the device's susceptibility to erosion. A flow-dampening chamber 112 is placed upstream of the primary outlet of the device. The chamber 12 has an opening which functions as both entrance and exit to the fluid. The chamber 112 and its opening are oriented such that flow path enters the chamber, where the fluid decelerates, and then exits the chamber and leads towards the primary outlet. The deceleration allows the fluid path to change direction towards the outlet while preventing potential erosive wear from the high-velocity fluids and/or any entrained solid particles. Further, it is expected that liquids and/or solids would accumulate within the chamber, dampening the impact of the main flow on the chamber walls and further reducing the likelihood of erosion. This concept can be applied to any situation where a change in direction or a deceleration of fluids is required and erosive wear is a concern (for example in pipe elbows).

Figure 9:
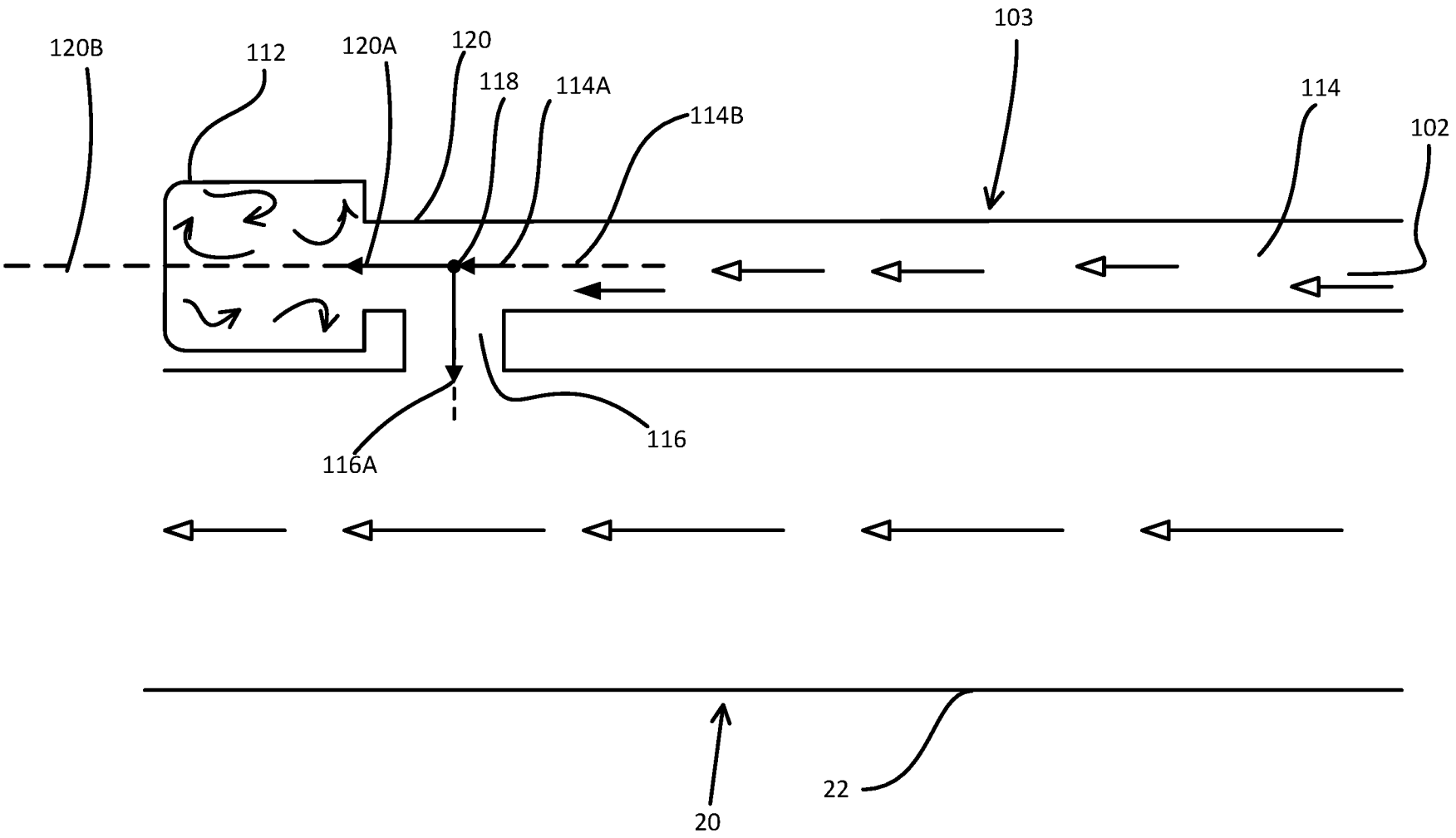
FIG. 9 is a schematic illustration of a further implementation of a flow control device installed within production tubing, and showing material flows during an operational implementation of the system.
Figure 10:
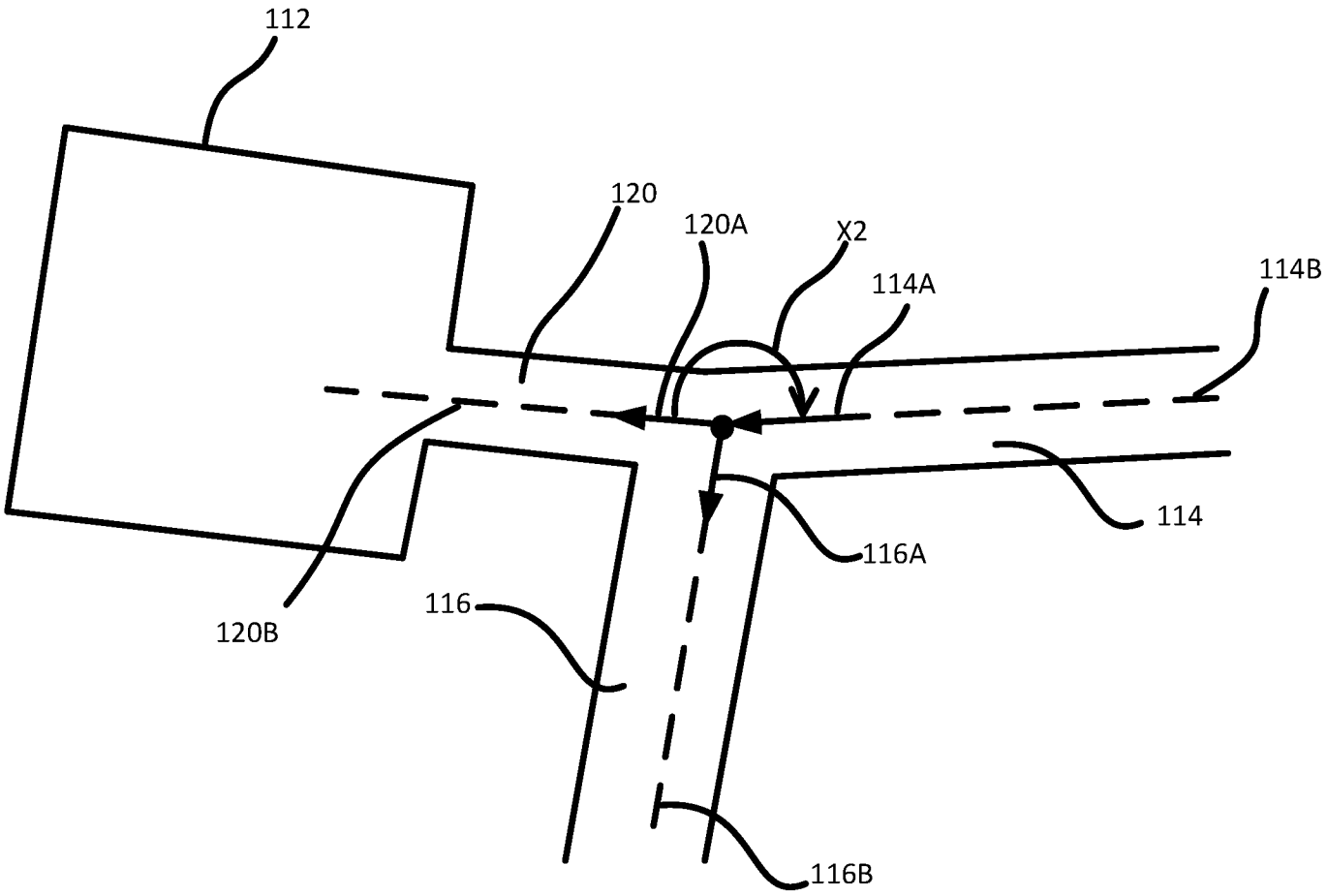
FIG. 10 is a schematic illustration of a portion of an alternative implementation of the flow control device illustrated in FIG. 7, showing the fluid passages extending from the branching point.

In this respect, and referring to FIGS. 9 and 10, the flow control device 100 is provided with a flow dampening chamber 112. In some implementations, for example, the flow dampening chamber 112 includes a stagnant chamber. The flow dampening chamber 112 is provided for dissipating energy of steam being conducted from the oil sands reservoir 30 and into the production well 20, and to mitigate or limit erosion that can be effected within the production conduit 22 by the entering steam.

The flow control device 100 includes an inlet 102 for receiving fluid from the hydrocarbon-containing reservoir 20. The flow control device 100 also defines a device-traversing fluid passage 105 for conducting fluid received by the inlet 102 from the hydrocarbon-containing reservoir 30. The device-traversing fluid passage 105 extends from the inlet 102 to the production conduit 22. The device-traversing fluid passage 105 includes an upstream fluid conducting passage 114 and a production conduit connecting passage 116. In some implementations, for example, the device-traversing fluid passage 105 consists of the upstream fluid conducting passage 114 and the production conduit connecting passage 116.

At a downstream branching point 118, the upstream fluid conducting passage 114 branches into at least the production conduit connecting passage 116 and a fluid connector passage branch 120. The well-connecting passage branch 116 extends from the branching point 118 to the production conduit 22 and is provided for effecting fluid communication between the branching point 118 and the production conduit 22, and thereby conducting fluid from the branching point 118 to the production conduit 22. The fluid connector passage branch 120 extends from the branching point 118 to the flow dampening chamber 112 for effecting fluid communication between the device-traversing fluid passage 105 and the flow dampening chamber 112.

Referring to FIG. 9, the ray 120A that is extending from the branching point 118: (a) along the axis 120B of the portion of the fluid connector passage branch 120 that is extending from the branching point 118, and (b) in the direction in which at least a fraction of the fluid, that has been received by inlet 102 from the hydrocarbon-containing reservoir, and which the fluid connector passage branch 120 is configured to conduct towards the flow dampening chamber 112, is being conducted within the fluid connector passage branch 120 when the fluid is being received by the inlet 102, is disposed at an obtuse angle "X2" of greater than 165 degrees (including 180 degrees) relative to the ray 114A, that is extending to the branching point 118: (a) along the axis 1146 of the portion of the upstream fluid conducting passage 114 that is extending from the branching point 118, and (b) in the direction in which the fluid, that has been received by the inlet 102 from the hydrocarbon-containing reservoir, and which the upstream fluid conducting passage 114 is configured to conduct towards the flow dampening chamber 112, is being conducted within the upstream fluid conducting passage 114 when the fluid is received by the inlet 102.

In some of these implementations, for example, the axis 120B of the portion of the fluid connector passage branch 120 that is extending from the branching point 118, is disposed in alignment, or substantial alignment, with the axis 114B of the portion of the upstream fluid conducting passage 114 that is extending to the downstream branching point 118.

The axis 116B, of the portion of the production well connecting passage 116 that is extending from the downstream branching point 118, is disposed at an angle of between 45 degrees and 135 degrees relative to the axis 114B of the portion of the upstream fluid conducting passage 114 that is extending to the downstream branching point 118. In some implementations, for example, the axis 116B, of the portion of the production conduit connecting passage 116 that is extending from the downstream branching point 118, is disposed orthogonally, or substantially orthogonally, relative to the axis 114B of the portion of the upstream fluid conducting passage 114 that is extending to the downstream branching point 118.

In some implementations, for example, the flow dampening chamber 112 includes a dimension, extending along the axis 120B of the portion of the fluid connector passage branch 120 that is extending from the branching point 118, equivalent to at least one (1) diameter of the upstream fluid conducting passage 114. In some of these implementations, for example, this dimension is at least 1.5 diameters of the upstream fluid conducting passage 114, such as at least two (2) diameters of the upstream fluid conducting passage 114.

In some implementations, for example, the flow dampening chamber 112 includes a diameter that is equivalent to at least one (1) diameter of the upstream fluid conducting passage 114. In some of these implementations, for example, the diameter of flow dampening chamber 112 is at least 1.5 diameters of the upstream fluid conducting passage 114, such as at least two (2) diameters of the upstream fluid conducting passage 114.

By configuring the relative orientation of the fluid passages 114, 116, 120 in this manner, where the fluid being conducted within the upstream fluid conducting passage 114 includes uncondensed steam, and when the fluid reaches the branching point 118, the uncondensed steam, by virtue of its momentum and relatively low viscosity, has a tendency to remain flowing in the same or substantially the same direction. This means that the uncondensed steam has a tendency to continue flowing into the flow dampening chamber 112, rather than changing direction to enter the well connecting passage. As a result, the steam flows into the flow dampening chamber 112, loses energy, eventually reversing its direction and exiting the chamber 112, and then proceeding to flow to the production conduit 22 via the production conduit connecting passage 116. The dampening of the steam flow further contributes to the restricting of stream flow from the oil sands reservoir 30 to the production well 20, and also mitigates erosion, including that which can be caused by entrained particulate solids. Any solids within the fluid that reaches the flow dampening chamber 112 can accumulate within the chamber 112, thereby providing additional erosion protection from impacting particulate solids. Like the uncondensed steam, entrained solids will also have a tendency to flow into the dampening chamber 112: Once in the dampening chamber, the solids will accumulate within the dampening chamber 112 or exit the chamber 112 at a reduced velocity.

In a related aspect, there is provided a method of producing bitumen from an oil sands reservoir 30, the oil sands reservoir having a SAGD well pair 10, 20, and the flow control device 100 being installed in fluid communication with the production well 20 of the SAGD well pair. Steam is injected into the reservoir 30 such that mobilization of the bitumen is effected. Under upset conditions, uncondensed steam can enter the flow control device 100 through the inlet 102 and is conducted to the formation fluid conducting passage 114. At least a fraction of the received reservoir fluid mixture fraction is conducted to the flow dampening chamber 112, via the formation fluid conducting passage 114, so as to effect a reduction in the mass flow rate of the conducted reservoir fluid mixture fraction. The energy-reduced reservoir fluid mixture fraction is then conducted to the production conduit 22, enabling recovery of any entrained bitumen through the production well 20.

In another aspect, the device 100 is configured to effect a pressure drop through the use of a nozzle followed by a frictional-path geometry, placed in series. The nozzle creates a dynamic pressure drop primarily by accelerating the fluid, while the frictional-path geometry creates a pressure drop through viscous shear.

The nozzle is sized such that a liquid that is at saturated or near-saturated conditions will incur some phase change to gas on account of the pressure drop within the nozzle. The frictional-path geometry is sized such that minimal pressure drop will occur for single-phase liquid flow for the design mass flow rate, however more significant pressure drop will occur when a lower-density (and thus higher-velocity) gas phase is present.

As such, under certain operating conditions, gas evolves from the liquid at the nozzle and creates a greater pressure drop both through the nozzle and the frictional-path geometries, when compared with the pressure drop for a single-phase liquid flow at the same mass flow rate.

This implementation includes the sequence of any nozzle or orifice that creates a dynamic pressure drop, followed in series by a geometry that is designed to create a frictional-path or wall-shear-based pressure drop.

Figure 11:
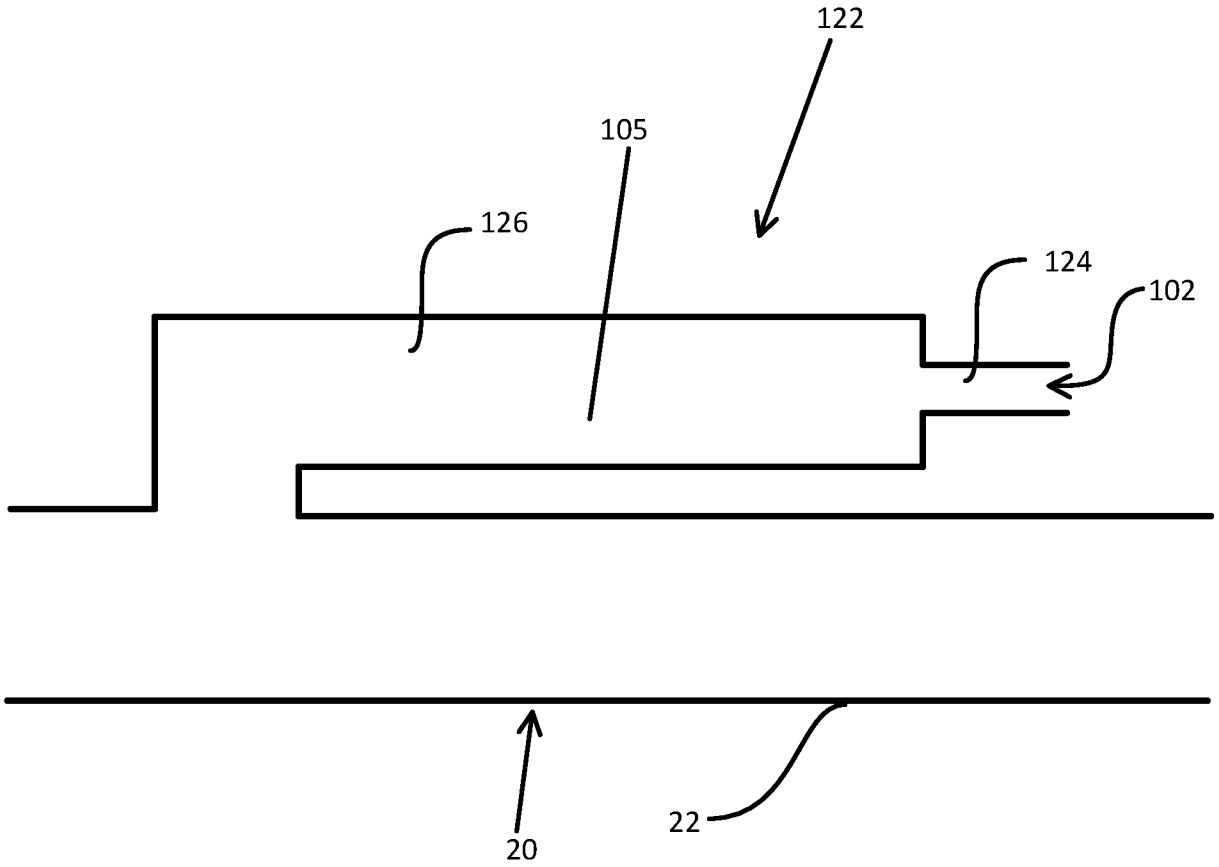
FIG. 11 is a schematic illustration of a further implementation of a flow control device installed within production tubing.
Figure 12:
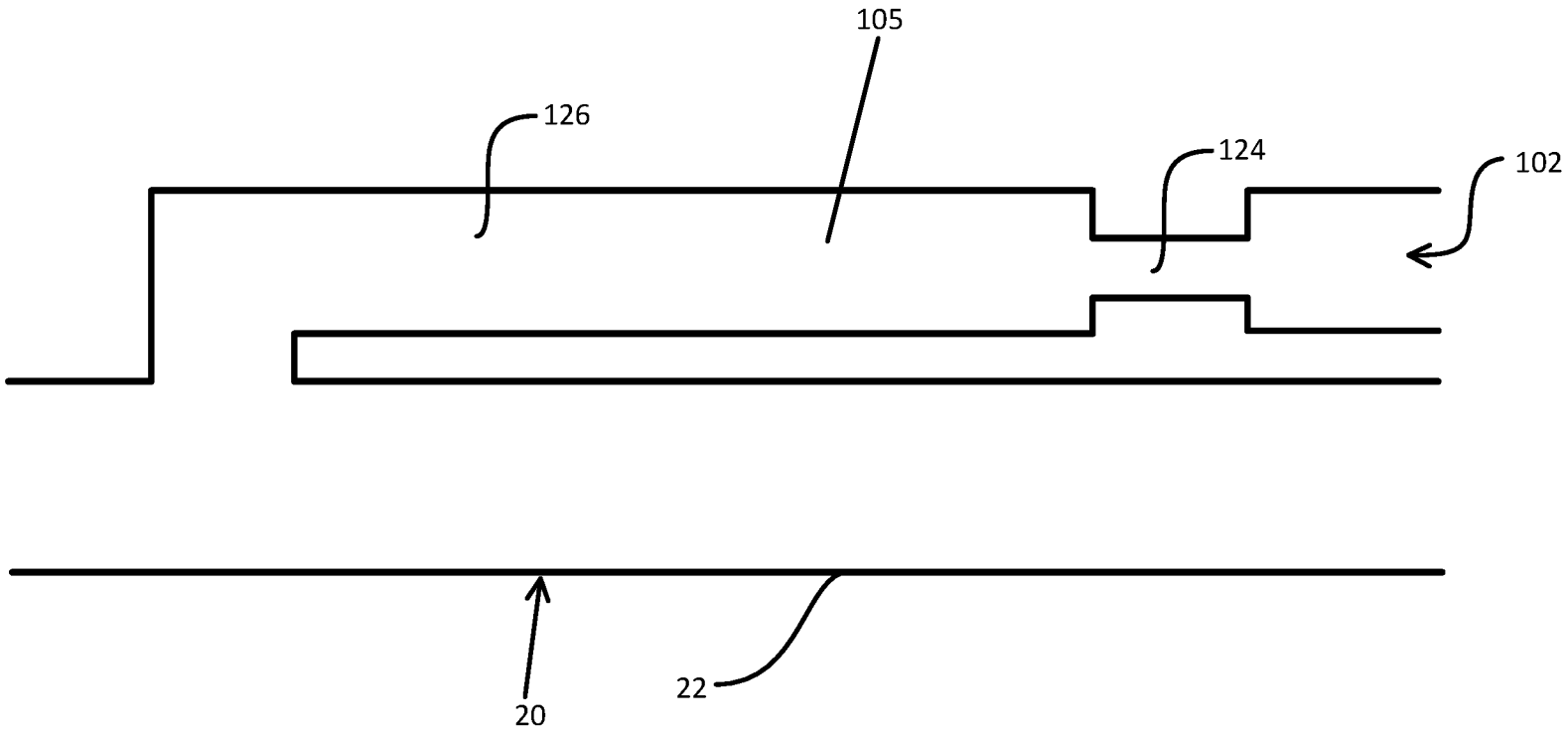
FIG. 12 is a schematic illustration of an alternative implementation of the flow control device illustrated in FIG. 11, as installed in fluid communication with production tubing.

In this respect, referring to FIGS. 11 and 12, the flow control device 100 is configured such that, when the fluid received by the flow control device 100 includes hot water, the hot water becomes vaporized, and relatively significant interference is provided to the resulting steam flow through the flow control device 100. On the other hand, when the fluid received by the flow control device 100 is liquid (for example, liquid including condensed water and bitumen) at a relatively lower temperature, relatively less interference is provided to the flow of such liquid through the flow control device 100.

In this respect, the flow control device 100 includes an inlet 102 for receiving reservoir fluid from the oil sands reservoir 20, and a device-traversing fluid passage 105 extending from the inlet to the production conduit 22. The device-traversing fluid passage 105 is provided for conducting the received reservoir fluid to the production conduit 22. In some implementations, for example the inlet 102 defines the inlet of the device-traversing fluid passage 105.

The device-traversing fluid passage 105 includes an upstream fluid conducting passage 124 and a downstream fluid conducting passage 126. In some implementations, for example, and specifically referring to FIG. 11, the device-traversing fluid passage 105 consists of the upstream fluid conducting passage 124 and the downstream fluid conducting passage 126.

The downstream fluid conducting passage 126 has a cross-sectional flow area that is greater than the cross-sectional flow area of the upstream fluid passage 124. In this respect, the upstream fluid passage 124 is relatively more constricted than the downstream fluid passage 126. By flowing relatively hot water through the relatively constricted upstream fluid passage 124, the conducted hot water is accelerated, resulting in a concomitant pressure decrease sufficient to effect vaporization of at least a fraction of the flowing hot water. As the vaporized hot water (i.e. steam) is conducted through the wider cross-sectional flow area of the downstream fluid conducting passage 126, the admixture decelerates, and, concomitantly, increases in pressure, and experiences flow resistance while being conducted through the downstream fluid conducting passage 126. Because the downstream fluid conducting passage 126 has a relatively larger cross-section flow area, if the fluid received by the inlet 102 is liquid (for example, liquid including condensed steam and bitumen) at a relatively lower temperature, the downstream fluid conducting passage 126 does not provide significant flow resistance to the liquid flow and the liquid is conducted through the downstream fluid conducting passage at an acceptable rate.

In a related aspect, there is provided another method of producing bitumen from an oil sands reservoir. The method includes injecting steam into the reservoir 30 such that bitumen is mobilized, and a reservoir fluid mixture, including hot water, is generated. The reservoir fluid mixture is conducted through a constricted passage such that the conducted hot water is accelerated, resulting in a concomitant pressure decrease sufficient to effect vaporization of at least a fraction of the conducted hot water. The vaporized water is then conducted through a downstream fluid passage, having a relatively larger cross-sectional flow area than the constricted fluid passage, and to the production well.

Figure 13:
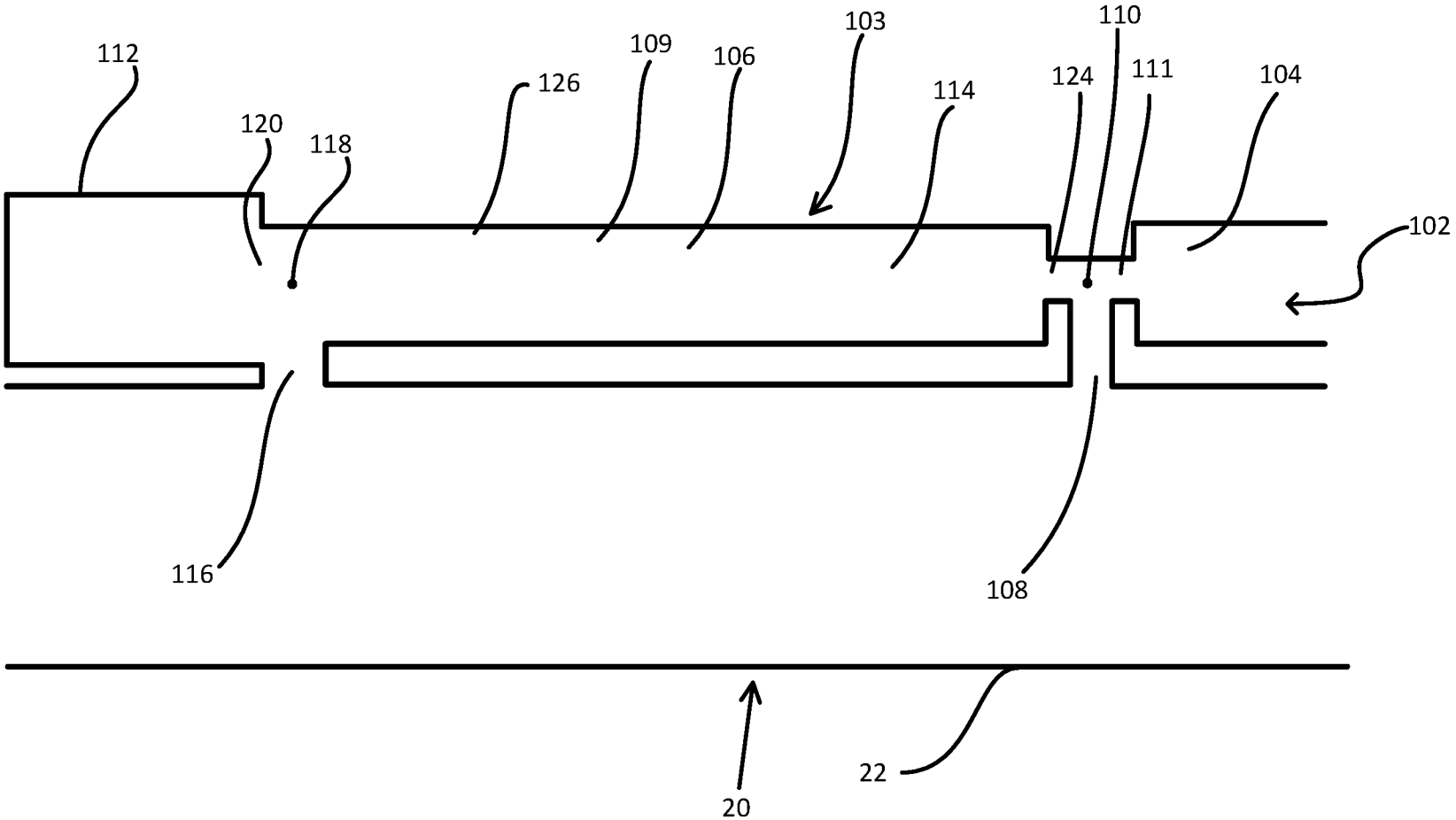
FIG. 13 is a schematic illustration of a further implementation of a flow control device installed within production tubing, incorporating various aspects illustrated in FIGS. 1 to 12.
Figure 14:
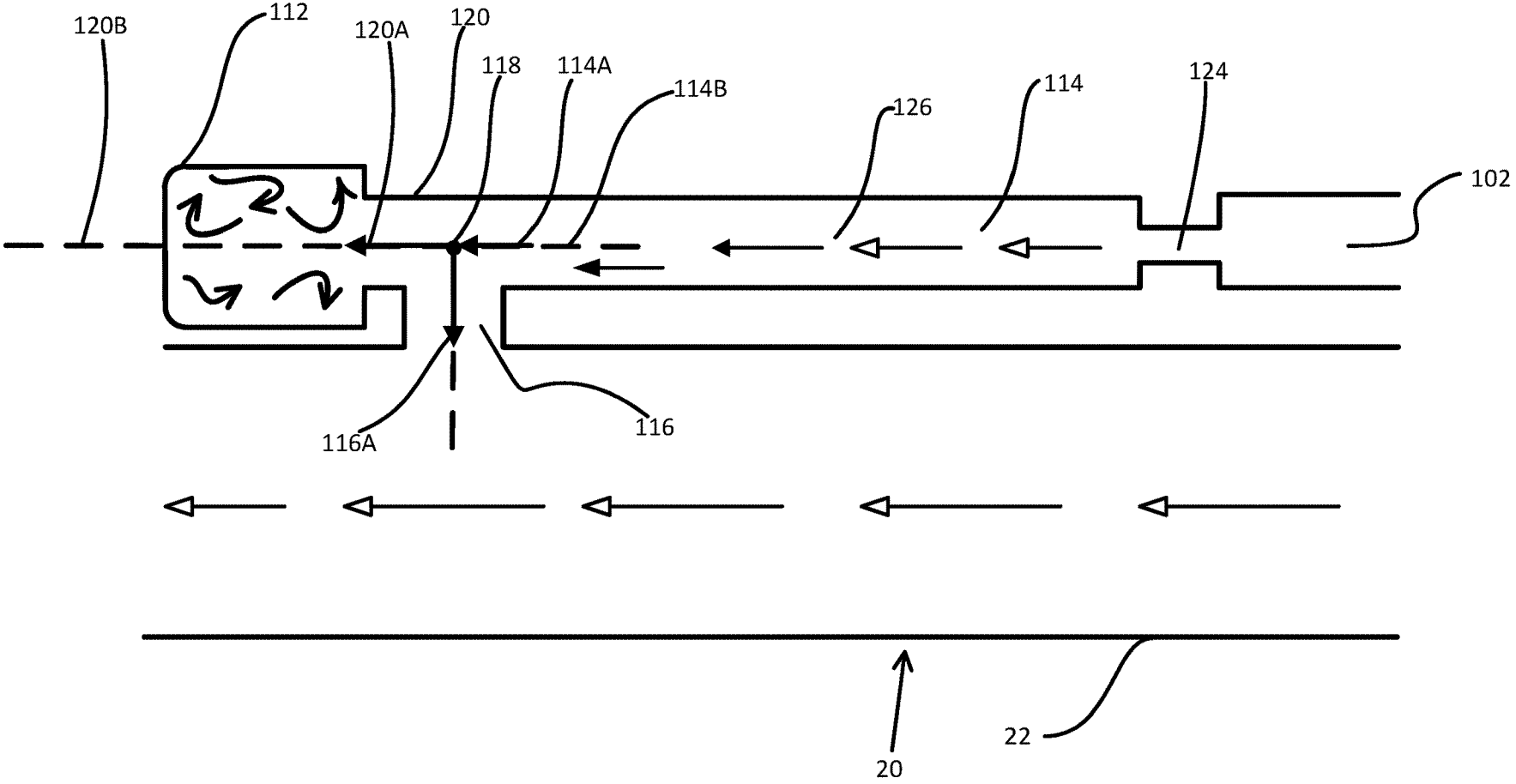
FIG. 14 is a schematic illustration of a further implementation of a flow control device installed within production tubing, incorporating aspects illustrated in FIGS. 9 and 12.

In some implementations of the flow control device 100, the above-described aspects can be combined, as illustrated in FIGS. 13 and 14. It is understood that two or more of the above-described aspects can be combined to provide a flow control device 100 for use with the production conduit 22.

One implementation of the flow control device 100 includes a first fluid conducting passage and a second fluid conducting passage, each having a substantially constant cross-sectional flow diameter along the length of the fluid conducting passage. The first fluid conducting passage is configured to ensure that the fluid, passing through the flow control device 100, is at its lowest pressure within the first fluid conducting passage, near the inlet of the device 100. Pressure is made to drop sufficiently to flash water in the first fluid conducting passage, and the pressure drop is dictated by the diameter and length of the first fluid conducting passage and operational parameters of the production well 20 (e.g., level of subcool, drawdown, and flow rate, and the like).

Where the first fluid conducting passage is too short, the first fluid conducting passage will not provide sufficient residence time for flashing to steam within this section. However, where the first fluid conducting passage is too long, it will lead to a performance transition from a system that is dominated by acceleration-induced pressure drop to one that is primarily viscosity-dependent, which is undesirable in this first fluid conducting passage, as it would lead to higher pressure drop for liquid flow than is necessary for the flow control device to work.

In some implementations, the flow control device 100 is designed to allow the pressure drop to be reversible (i.e., associated with fluid acceleration) so that single phase flow will incur a pressure recovery downstream, and, along the length of the flow control device 100 (including through the first fluid conducting passage and the second fluid conducting passage), the fluid will have be a limited pressure drop. For a given operating condition (drawdown), the less steam or saturated liquid water is produced, the higher the mass flow rate. When the production fluids at the inlet are at or near saturation conditions, the liquid water at the inlet flashes to steam in the first passageway and an increased pressure drop will occur in the second fluid conducting passage, limiting the mass flow rate to surface.

The purpose of causing the flashing in the first fluid conducting passage in the flow control device 100 is to cause an acceleration of the fluid downstream where the second fluid conducting passage will create an added pressure drop. When the fluids from the formation entering the flow control device 100 are sufficiently subcooled, no flashing occurs and minimal pressure drop is created across the entire device 100. When steam is present with liquids at the inlet, the flashing in the first fluid conducting passage in the flow control device 100 still operates the same way as it simply accelerates the mixture further down the first fluid conducting passage and then the second fluid conducting passage of flow control device 100.

The second fluid conducting passage has a diameter and length that is proportional to that of the cross-sectional diameter of the first fluid conducting passage. The purpose of the second fluid conducting passage is to transition the fluid to viscosity-dependent flow in the second fluid conducting passage. The second fluid conducting passage is configured to achieve as high a pressure drop as possible with mixed flow (when steam is present in the oil and water), such that mass flow rate will be limited when steam is present and limiting passage of steam into the production tubing. When steam is not present, the second fluid conducting passageway is configured to provide as low a pressure drop as possible with liquid flow (no steam present), to maximize mass flow rate. The second fluid conducting passage is also responsible for effecting an irreversible pressure drop of the fluid passing though this portion of the flow control device 100.

The second fluid conducting passage is also configured to contain and dissipate a potential high-speed fluid jet exiting the first fluid conducting passage. If such a jet were allowed to enter the main production tubing 22 without being dissipated first, it would pose an erosion risk to any tubing strings inside the production tubing, or even the opposite wall of the production tubing itself.

Figure 15:
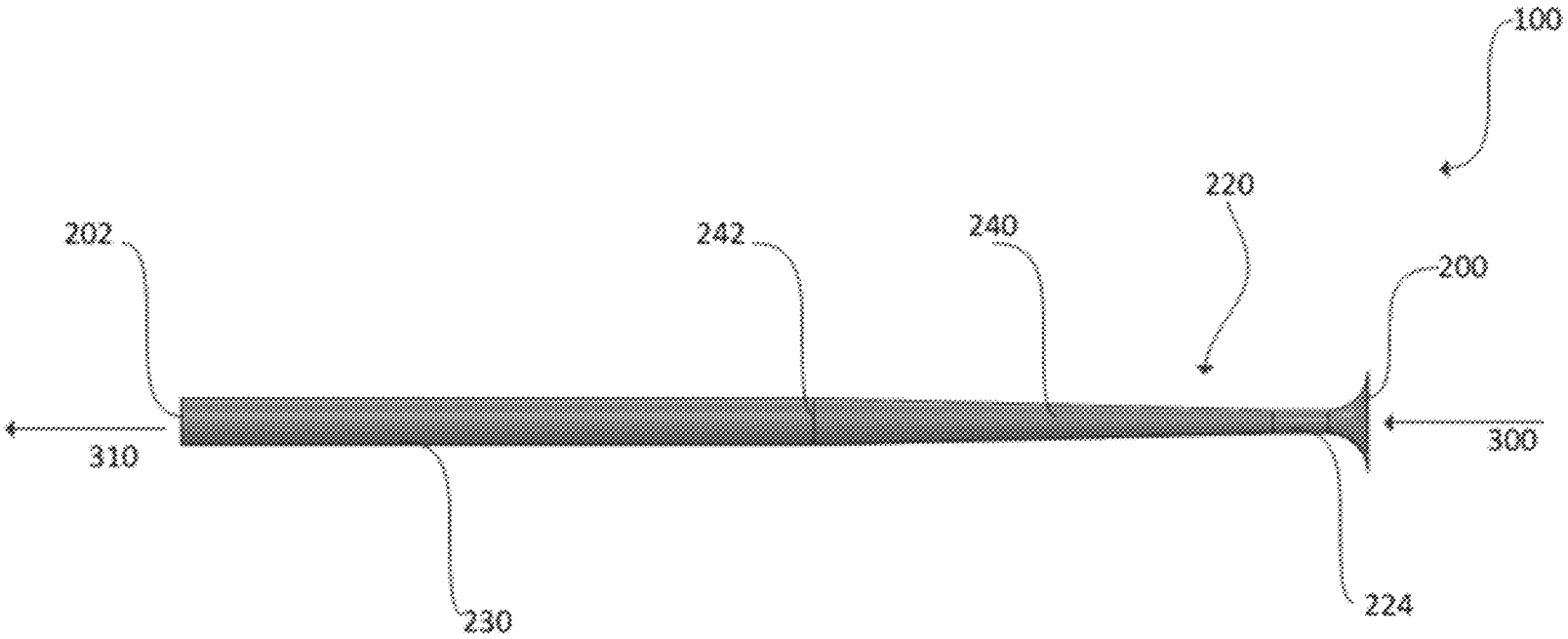
FIG. 15 is a schematic side view illustrating the flow path of a fluid flowing in the flow control device according to an implementation.

FIG. 15 is a schematic side view illustrating the flow path of a fluid flowing in the flow control device according to an implementation. In this implementation, flow control device 100 includes an inlet 200 for receiving fluid from the oil sands reservoir 30 in the direction 300. The flow control device 100 also has a first constricted passage portion 220 to define the first fluid conducting passage and a second constricted passage portion 230 to define the second fluid conducting passage.

In this implementation, the first constricted passage portion 220 has a throat portion 224. The throat portion 224 defines the first fluid conducting passage in this implementation. The first fluid conducting passage has the same cross-sectional flow area along the length of the first fluid conducting passage. In some implementations, the first fluid conducting passage has substantially the same cross-sectional flow area along the length of the first fluid conducting passage. Downstream of the throat portion 224 is the tapered portion 240, the tapered portion 240 defines a transition passage that has the same cross-sectional flow area as the first fluid conducting passage. In this implementation, the cross-sectional flow area of the transition passage increases from the end proximate the throat portion 224 to the other end of the tapered portion 240.

In the illustrated implementation, the second constricted passage portion 230 defines the second fluid conducting passage in this implementation. The second fluid conducting passage has a uniform cross-sectional flow area along the length of the second fluid conducting passage. In some implementations, the cross-sectional flow area along the length of the second fluid conducting passage is substantially uniform. The tapered portion 240 provides a transition passage between the first fluid conducting passage and the second fluid conducting passage.

In the illustrated implementation, the first constricted passage portion 220 defines a cylindrical shaped first fluid conducting passage and the second constricted passage portion 230 defines a cylindrical shaped second fluid conducting passage. The tapered portion 240 defines a transition passage having a truncated cone cylindrical shape. In some implementations, the first fluid conducting passage, the second fluid conducting passage, and/or the transition passage can have other shapes known to a person skilled in the art.

Fluid from the oil sands reservoir 30 is received at inlet 200 and passes through the first fluid conducting passage 210 defined by the first constricted passage portion 220. The fluid then passes through the transition passage defined by the tapered portion 240. The fluid then passes through the second fluid conducting passage defined by the second constricted passage portion 230 and out of flow control device 100 in direction 310. The cross-section flow area of the first fluid conducting passage is less than the cross-sectional flow area of the second fluid conducting passage.

Figure 16A:
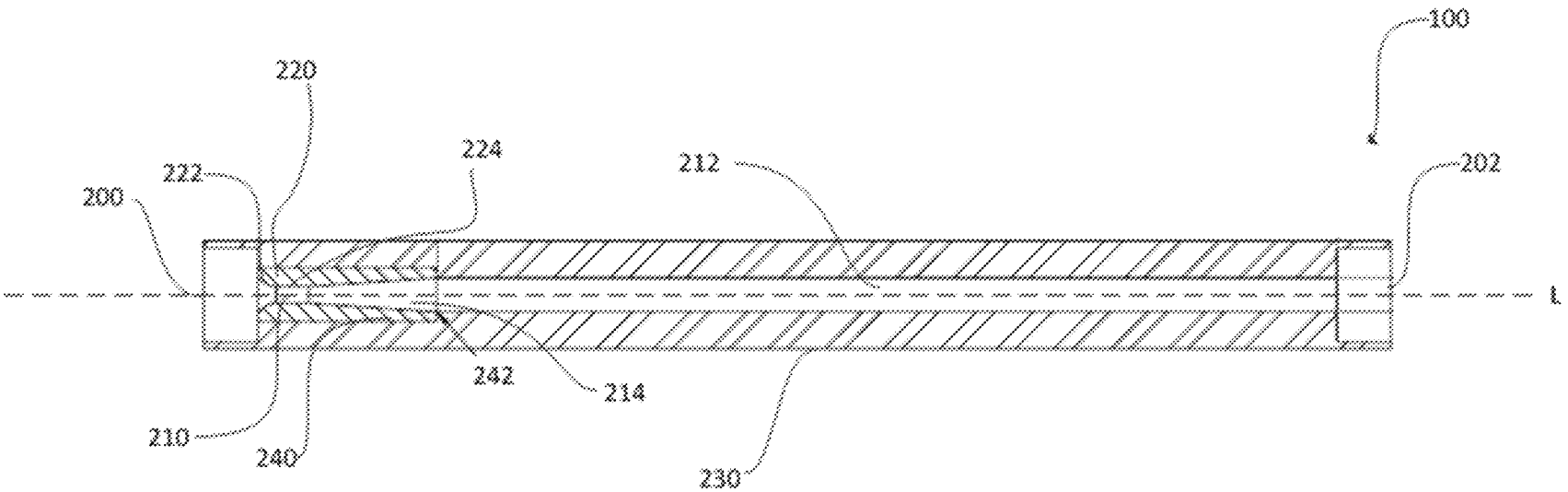
FIG. 16A is a side cross-sectional view of a flow control device according to an implementation.

FIG. 16A is a side cross-sectional view of a further implementation of a flow control device 100 with features similar to that illustrated in FIG. 15. In this implementation, the flow control device 100 includes an inlet 200, an outlet 202, a first constricted passage portion 220, and a second constricted passage portion 230. The first constricted passage portion 220 includes a curved entry portion 222 and a throat portion 224. Curved entry portion 222 defines an entry passage for the fluid from the formation between the inlet 200 and the throat portion 224. The curved entry portion 222 has a geometry to limit irreversible pressure drop of the fluid being received from inlet 200. The throat portion defines the first fluid conducting passage 210. The flow control device 100 also includes tapered portion 240 which is downstream of the throat portion 224.

In this implementation, the first fluid conducting passage 210 has the same cross-sectional flow area along the length of the first fluid conducting passage 210 (i.e., as defined by throat portion 224). In some implementations, the cross-sectional flow area is substantially constant along the length of the first fluid conducting passage 210.

The tapered portion 240 defines a transition passage 214 for the fluid from the formation leaving the first fluid conducting passage 210 and interfaces with the end of the throat portion 224 distal from the inlet 200. The transition passage 214 has a cross-sectional flow area that increases from one end, being the same as that of the first fluid conducting passage 210, to the other end, which has a cross-sectional flow area that is the same as that of the second fluid conducting passage 214. The transition passage 214 provides a transition between the first fluid conducting passage 210 and the second fluid conducting passage 214.

In this implementation, the transition passage 214 extends at a transition angle of 1.5 degrees relative to the central longitudinal axis of flow control device 100 from one end of the tapered portion 240 to the other end. In some implementations, the transition angle is between 0.5 degrees and 30 degrees. In some implementations, the transition angle is between 30 degrees and 90 degrees.

As with the implementation shown in FIG. 15, in this implementation, the second fluid conducting passage 212 has a constant cross-sectional flow area along the length of the second fluid conducting passage 212. In some implementations, the cross-sectional flow area is substantially constant along the length of the second fluid conducting passage 212. Fluid passes through the second fluid conducting passage 212 and exits to the production conduit 22 at outlet 202.

In this implementation, the ratio between the cross-sectional diameter of the first fluid conducting passage 210 and the cross-sectional diameter of the second fluid conducting passage 212 is 2:1. In one implementation, the cross-sectional diameter of the first fluid conducting passage 210 is 3 mm and the diameter of the second fluid conducting passage 212 is 6 mm. In one implementation, the transition angle is 1.5 degrees relative to the central longitudinal axis of the flow control device 100 (denoted as "L" in FIG. 16A).

In some implementations, the length of the flow control device 100 is 150 mm. In some implementations, the cross-sectional diameter of the first fluid conducting passage is between 2 mm and 5 mm. In some implementations, the cross-sectional diameter of the first fluid conducting passage is between 1 mm and 7 mm. In some implementations, the cross-sectional diameter of the first fluid conducting passage is greater than 7 mm. In some implementations, the cross-sectional diameter of the first fluid conducting passage is at least 15 mm.

Figure 16B:
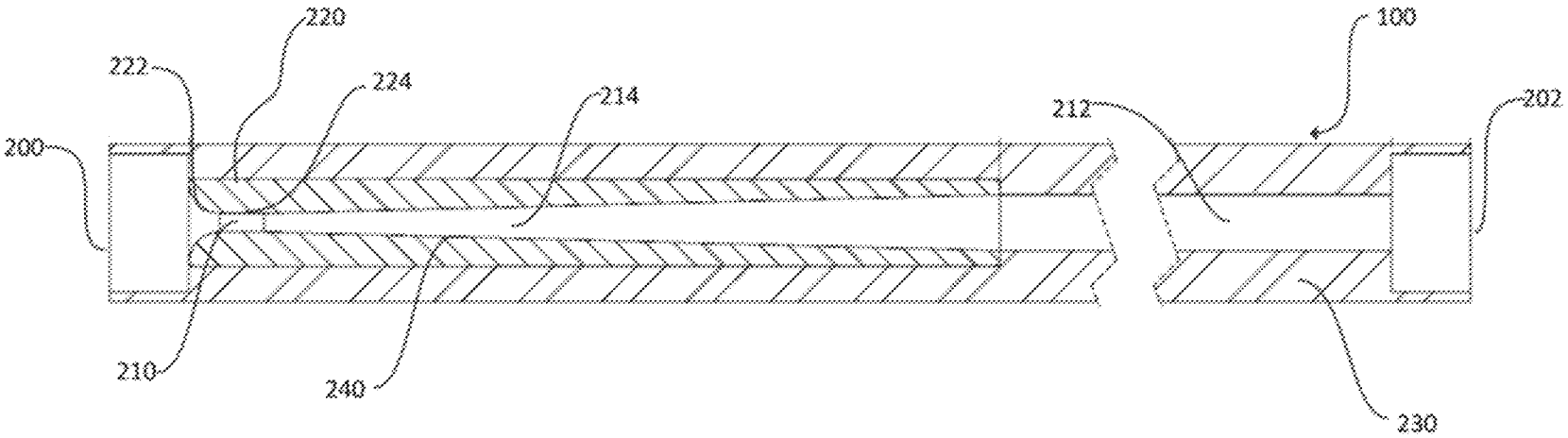
FIG. 16B is a side cross-sectional view of a flow control device according to an implementation.
Figure 16C:
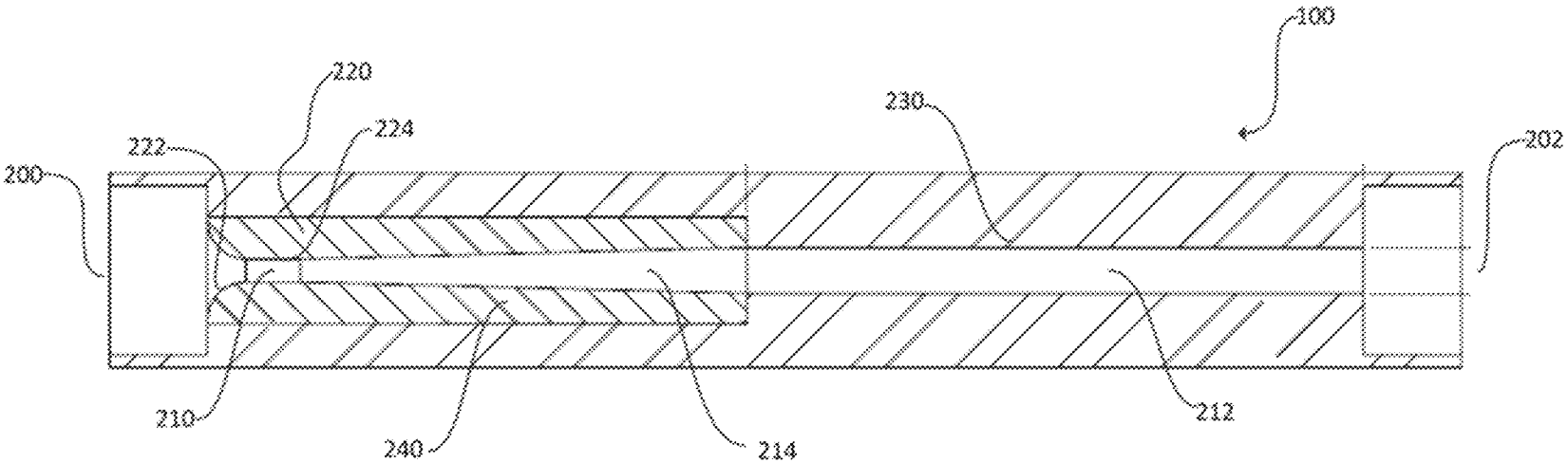
FIG. 16C is a side cross-sectional view of a flow control device according to an implementation.

FIGS. 16B and 16C are further implementations of the flow control device 100 having features similar to those described in FIGS. 15 and 16A.

FIG. 16B illustrates another implementation of the flow control device 100 where the ratio between the cross-sectional diameter of the first fluid conducting passage 210 defined by the throat portion 224 and the cross-sectional diameter of the second fluid conducting passage 212 defined by the second constricted portion 230 is 3:1. In one implementation, the cross-sectional diameter of the first fluid conducting passage 210 is 3 mm and the cross-sectional diameter of the second fluid conducting passage 212 is 9 mm. In this implementation, the transition angle of the transition passage 214 is 1.5 degrees relative to the central longitudinal axis of the flow control device 100 and the length of the flow control device 100 is 254 mm. The length of the flow control device 100 is longer for the implementation illustrated in FIG. 16A as the transition angle is the same as that illustrated in FIG. 16A, but the ratio between the cross-sectional diameter of the first fluid conducting passage 210 and the cross-sectional diameter of the second fluid conducting passage 212 is larger for the implementation illustrated in FIG. 16B when compared to that illustrated in FIG. 16A.

FIG. 16C illustrates another implementation of the flow control device 100 where the ratio between the cross-sectional diameter of the first fluid conducting passage 210 as defined by the throat portion 224 and the cross-sectional diameter of the second fluid conducting passage 212 as defined by the second constricted portion 230 remains at 3:1. In this implementation, the cross-sectional diameter of the first fluid conducting passage 210 is 3 mm and the cross-sectional diameter of the second fluid conducting passage 212 is 9 mm. The transition angle is greater than that of the implementation illustrated in FIG. 16B. Accordingly, the length of the flow control device can be reduced by having a steeper transition angle. In one implementation, the overall length of the flow control device 100 is 150 mm.

Figure 17:
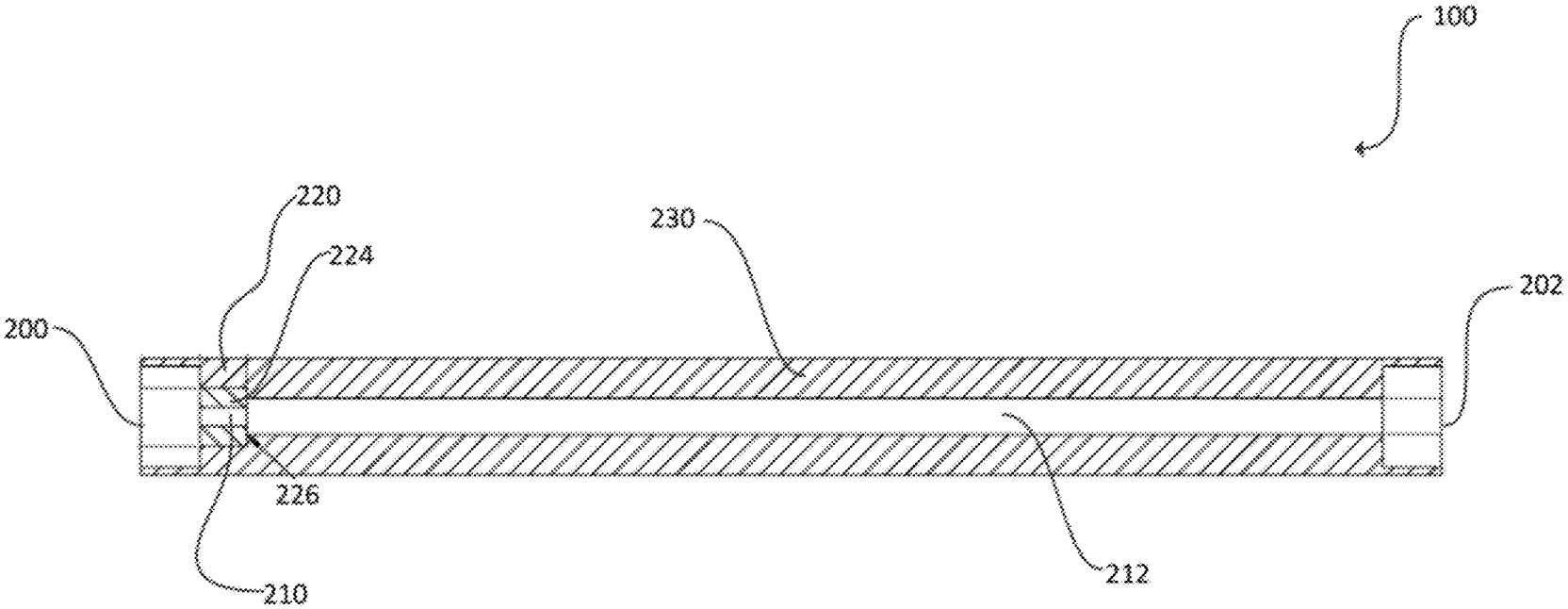
FIG. 17 is a side cross-sectional view of a flow control device according to an implementation.

FIG. 17 is a side cross-sectional view of a further implementation of a flow control device 100. As with the implementations illustrated in FIGS. 15 and 16A-C, the flow control device 100 includes an inlet 200, outlet 202, a first constricted passage portion 220, and a second constricted passage portion 230. In this implementation, the first fluid conducting passage 210 is formed entirely of throat portion 224, as the first constricted passage portion 220 does not include the curved entry portion 222. Fluid from the oil sands reservoir 30 is received at inlet 200 and passes into the first fluid conducting passage 210. The fluid then passes through the second fluid conducting passage 212 without a tapered portion or a transition passage. The cross-section flow area of the first fluid conducting passage 210 is less than the cross-sectional flow area of the second fluid conducting passage 212.

In this implementation, the first constricted passage portion 220 has a surface 226 that is perpendicular to the second fluid conducting passage 212 defined by the second constricted passage portion 230. In some implementations, the surface 226 can be at other angles. In some implementations, the surface 226 is a sharp step-change in diameter.

In some implementations, the first constricted passage portion 220 is shaped to fit into a cavity in the flow control device 100. In some implementations, the first constricted passage portion is removably coupled to the second constricted passage portion 230.

In some implementations, all components of the flow control device 100 are formed of steel. In some implementations, the components of the flow control device 100 are formed of tungsten carbide, other materials known to a person skilled in the art, or a combination of any of the foregoing.

In some implementations, the length of the second fluid conducting passage 212 defined by the second constricted passage portion 230 is 10× the cross-sectional diameter of the first fluid conducting passage 210 defined by the throat portion 224. In some implementations, the length of the second fluid conducting passage 212 is at least 10× the cross-sectional diameter of the first fluid conducting passage 210. In some implementations, the length of the second fluid conducting passage 212 defined by the second constricted passage portion 230 is in the range of 20× to 50× the cross-sectional diameter of the first fluid conducting passage 210. Accordingly, in some implementations, the cross-sectional diameter of the first fluid conducting passage 210 is 3 mm and the length of the second fluid conducting passage is 150 mm.

In some implementations, the first fluid conducting passage 210 has a length ranging from 7 mm to 10 mm.

In the implementations illustrated in FIGS. 15-17, when a gas and a liquid flow together and are well-mixed in the fluid passing through the flow control device 100, the effective speed of sound of the mixture drops considerably when compared with the speed of sound of each individual phase. Such drops in effective speed is caused by the speed of sound being proportional to the stiffness of the medium and inversely proportional to the density. In a gas-liquid mixture, the stiffness is similar to that of the gas phase, but the average density is much higher than the gas phase alone. Therefore, pressure waves travel much slower in the gas-liquid mixture.

The diameter of the first fluid conducting passage 210 is configured to cause a pressure drop that leads to phase change in the fluid passing through the first passage and to ensure that, when both gas and liquid phases are present, the two achieve this reduced sonic velocity (reduced due to the multiphase nature of the flow). This, in turn, ensures a higher pressure drop (or reduced mass flow rate) when the gas phase is present, further improving the characteristics of the operation of the flow control device 100, namely minimizing mass flow when gas phase is present and maximizing mass flow for all-liquid flow conditions. The second fluid conducting passage 212 can further enhance the operation of the flow control device 100 by containing and reflecting pressure waves generated by the sonic transitions.

In the implementations illustrated in FIGS. 15-16C, the flow control device 100 includes a tapered portion 240 for defining a transition passage 214 that provides a transition between the first fluid conducting passage 210 and the second fluid conducting passage 212. In some implementations, the transition geometry of the transition passage 214 is gradual. A gradual change limits irreversible pressure drop, which takes place when the fluid passages through the second fluid conducting passage 212. The transition cannot, however, be too gradual because the transition passage 214 will become longer, and irreversible pressure drop can become a problem. A gradual change, rather than a step change, can limit or eliminate local circulation patterns or eddies in the flow, which could be detrimental to the robustness of the flow control device 100. The circulation patterns can also create locations of elevated erosion rates, and should be avoided to reduce the amount of erosion of the flow control device. Furthermore, a gradual geometry change between the first fluid conducting passage 210 and a second fluid conducting passage 212 can extend the effects of the multiphase transonic flow, as sonic flow would occur at the exit of the first fluid conducting passage 210. The occurrence of sonic flow can enhance the performance of the flow control device 100 by enhancing the pressure drop under choked flow conditions.

In some implementations, the tapered portion 240 defines a transition passage that extends at an angle of 1.5 degrees relative to the central longitudinal axis of the flow control device 100. In some implementations, the transition angle has a range between 0.5 degrees and 30 degrees.

In some implementations, the flow control device 100 is used for production wells configured for SAGD operations. In some implementations, the flow control device 100 is used in wells configured for other types of enhanced recovery methods that use other fluids, in place of steam, that incur phase change as part of the production system.

Figure 18:
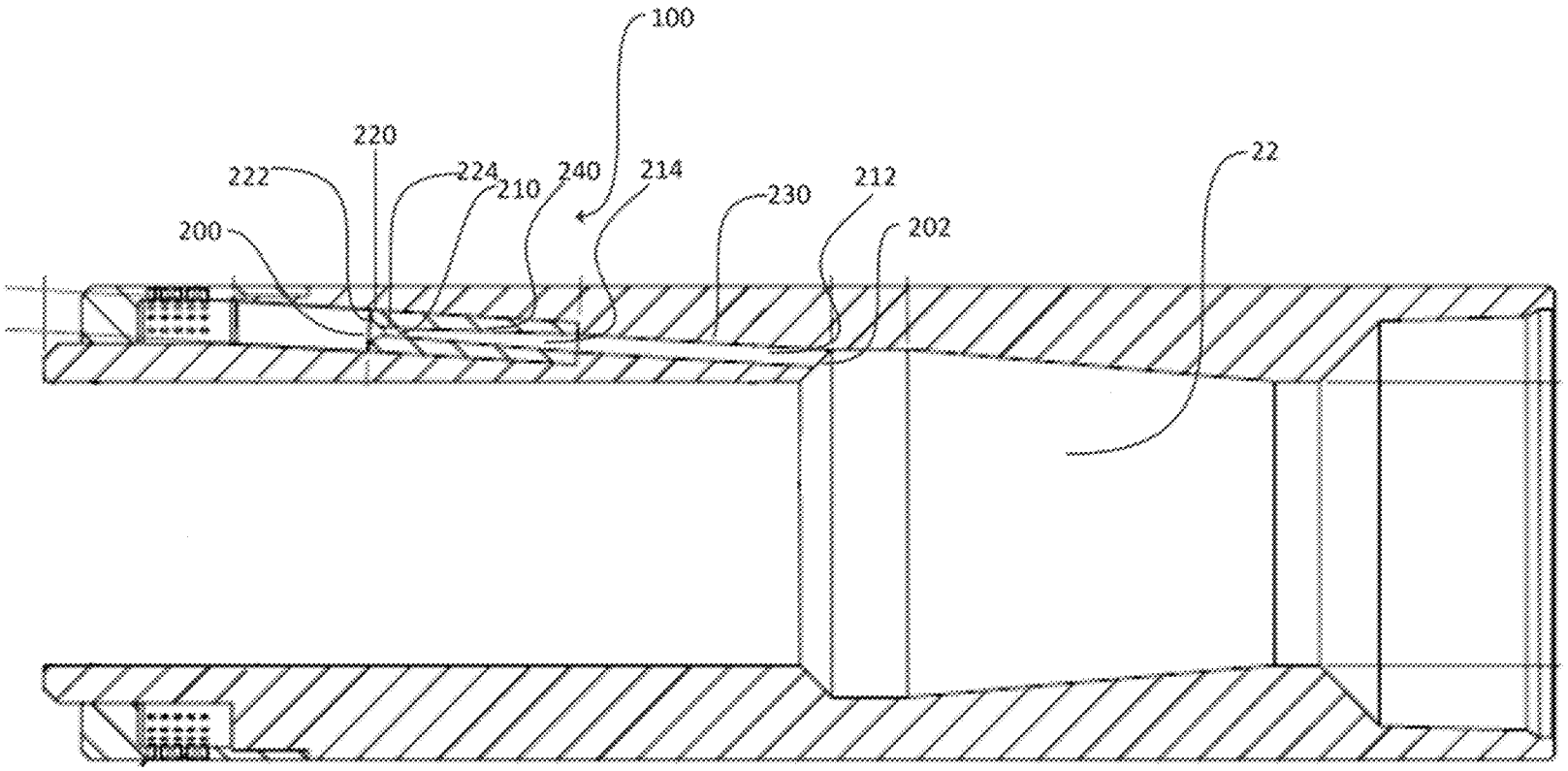
FIG. 18 is a schematic illustration of a flow control device as would be installed within a production tubing according to an implementation.

FIG. 18 is a cross-sectional side view illustrating the flow control device 100 installed on production tubing for production conduit 22. In FIG. 18, only one flow control device 100 is installed on one side of the production tubing. In some implementations, more than one flow control device 100 can be installed in the tubing for production conduit 22. In some implementations, a flow control device 100 is installed on each side of the tubing for production conduit 22. In the illustrated implementation, the flow control device 100 as illustrated in FIG. 16C is installed in the production conduit tubing.

Fluid from the formation enters the flow control device 100 at inlet 200 and enters curved entry passage 222. The fluid then enters the first fluid conducting passage 210 defined by the throat portion 224 of the first constricted passage portion 220, which is configured to flash the fluid passing through the first fluid conducting passage 210.

The fluid then exits the first fluid conducting passage 210 and into transition passage 214 defined by tapered portion 240. The cross-sectional flow area of the first fluid conducting passage 210 is the same as that of the transition passage 214 at the end of the transition passage 214 immediately downstream of the first fluid conducting passage 210. The fluid then travels down the transition passage 214 as the cross-sectional flow area increases until the cross-sectional flow area is the same as that of the second fluid conducting passage 212 defined by the second constricted passage portion 230. In the second fluid conducting passage 212, the fluid transitions to viscosity-dependent flow in the second fluid conducting passage and a pressure drop is achieved in the fluid. The fluid then exits the flow control device 100 and into the production conduit 22.

Both (a) the proportion of the cross-sectional diameter of the first fluid conducting passage 210 and the second conducting passage 212 and (b) the proportion between the cross-sectional diameter of the first fluid conducting passage 210 and the length of the second fluid conducting passage 212 have an effect on the effectiveness of flow control device 100 in creating a pressure drop in the formation fluid flowing through the device.

Figure 19:
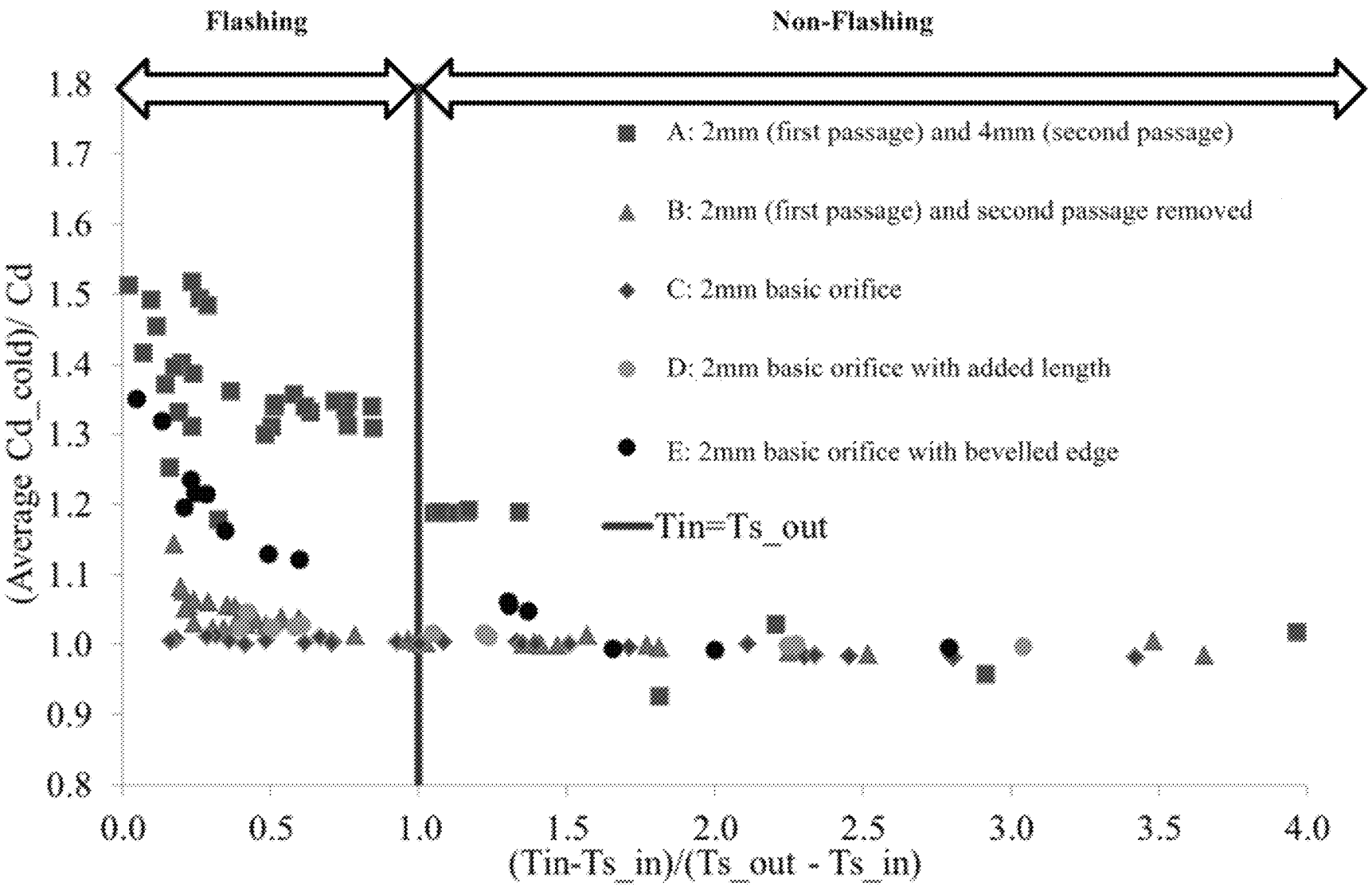
FIG. 19 is a graph illustrating pressure drop performance for different implementations of flow control devices.

FIG. 19 is a graph illustrating the effect on pressure drop performance of different implementations of flow control devices. The flow control device 100 tested included one that is substantially similar to that as illustrated in FIG. 17 (denoted as "A" in the graph), one that has the second passage removed (denoted as "B" in the graph), and other basic orifices denoted as "C", "D", and "E" in the graph to provide a baseline set of results. The graph describes pressure drop performance in terms of a discharge coefficient (denoted as "Cd"), which is normalized to single phase flow performance. Other symbols used in the graph include: $T_{in}$=the inlet temperature (in ° C.), $T_{s_in}$=the saturation temperature in ° C. corresponding to the inlet pressure, $T_{s_out}$ is the saturation temperature in ° C. corresponding to the outlet reservoir pressure; and Cd_cold is the discharge coefficient at temperature below saturation temperature. The discharge coefficient is calculated using the following formula:

$$C_d = \frac{M}{A\sqrt{2dP \times \rho}}$$

where Cd=the discharge coefficient, A=area of the first passage, dP=pressure drop, ρ is density (kg/m$^3$), and M=mass flow rate (kg/s).

On the Y-axis of FIG. 19, a higher value indicates better performance in effecting a pressure drop. For the "A" implementation, FIG. 19 shows a 30% to 50% decrease in the discharge coefficient in the flashing regime relative to that of the non-flashing regime. Removal of the second passage (implementation "B") shows a 15% decrease in the discharge coefficient for flashing flows when compared to that of non-flashing flows. For other baseline implementations, the experiments indicate that the discharge coefficient decreases around 5% as the inlet is increased above saturation temperature corresponding to the outlet pressure, when compared to the cold flow. Accordingly, the "A" implementation, which is substantially similar to that as illustrated in FIG. 17, has an improved pressure drop performance compared to baseline flow control devices (the results of which are shown as implementations C, D, and E).

In the above description, for purposes of explanation, numerous details are set forth in order to provide a thorough understanding of the present disclosure. However, it will be apparent to one skilled in the art that these specific details are not required in order to practice the present disclosure. Although certain dimensions and materials are described for implementing the disclosed example implementations, other suitable dimensions and/or materials may be used within the scope of this disclosure. All such modifications and variations, including all suitable current and future changes in technology, are believed to be within the sphere and scope of the present disclosure. All references mentioned are hereby incorporated by reference in their entirety.

What is claimed is:

1. An inflow control device for regulating the flow of fluid from a hydrocarbon-containing reservoir into a production conduit, the inflow control device configured for fluid communication with the production conduit, and the inflow control device comprising:

an inlet for receiving reservoir fluid from the hydrocarbon-containing reservoir and communicating fluidly with a first fluid conducting passage;

the first fluid conducting passage having a first cross-sectional diameter, the first cross-sectional diameter being substantially constant along the first fluid conducting passage, wherein the first fluid conducting passage is configured to cause a reversible pressure drop within the reservoir fluid conducted therethrough;

a second fluid conducting passage for communicating fluidly with the first fluid conducting passage and having a second cross-sectional diameter, the second cross-sectional diameter being substantially constant along the second fluid conducting passage and greater than the first cross-sectional diameter at a defined ratio; and the second fluid conducting passage having a length that is proportional to the first cross-sectional diameter; and wherein the second fluid conducting passage is configured to cause an irreversible pressure drop of the reservoir fluid conducted therethrough and to reduce a mass flow rate of the reservoir fluid through the inflow control device into the production conduit.

2. The inflow control device of claim 1, wherein the defined ratio is 3:1 or 2:1.

3. The inflow control device of claim 1, wherein the length of the second fluid conducting passage is at least between 10X greater and 50X greater than the first cross-sectional diameter.

4. The inflow control device of claim 1, wherein the inflow control device comprises a transition passage connecting the first fluid conducting passage at one end and the second fluid conducting passage at the other end, the one end of the transition passage having substantially the same cross-sectional flow area as that of the first fluid conducting passage and the other end of the transition passage having substantially the same cross-sectional flow area as that of the second fluid conducting passage.

5. The inflow control device of claim 4, wherein the transition passage extends from the one end to the other end at an angle between 0.5 degrees and 30 degrees relative to the inflow control device's central longitudinal axis.

6. The inflow control device of claim 1, wherein the first cross-sectional diameter is in the range between 2 mm and 5 mm.

7. The inflow control device of claim 1, wherein the first fluid conducting passage has a length in the range between 7 mm and 10 mm.

8. The inflow control device of claim 1, comprising a curved entry passage positioned between the inlet and the first fluid conducting passage.

9. The inflow control device of claim 1, wherein the production conduit is configured for steam assisted gravity drainage operation.

10. The inflow control device of claim 1, wherein the length of the second fluid conducting passage is between 20X greater and 50X greater than the first cross-sectional diameter.

11. The inflow control device of claim 1, wherein the length of the second fluid conducting passage is between 10X greater and 20X greater than the first cross-sectional diameter.

12. The inflow control device of claim 1, wherein the inlet is positioned between the hydrocarbon-containing reservoir and the production conduit and the second fluid conducting passage is positioned between the inlet and the production conduit for establishing a fluid circuit therebetween that is at least partially separate from and substantially parallel to a flow of fluids within the production conduit.

13. A method of producing heavy oil from an oil sands reservoir, comprising:

injecting a fluid into the reservoir such that heavy oil is mobilized, and a reservoir fluid mixture, including heavy oil and water, is generated;

conducting the reservoir fluid mixture through a first fluid conducting passage such that the water of the reservoir fluid mixture is accelerated, resulting in a concomitant pressure decrease sufficient to effect vaporization of at least a fraction of the water, the first fluid conducting passage having a first cross-sectional diameter and the first cross-sectional diameter being substantially constant along the first fluid conducting passage, wherein the first fluid conducting passage is configured to cause a reversible pressure drop within the reservoir fluid mixture conducted therethrough;

conducting the vaporized water through a second fluid conducting passage and to a production conduit, the second fluid conducting passage having a second cross-sectional diameter, the second cross-sectional diameter being substantially constant along the second fluid conducting passage and greater than the first cross-sectional diameter at a defined ratio, and the second fluid conducting passage having a length that is proportional to the first cross-sectional diameter, wherein the second fluid conducting passage is configured to cause an irreversible pressure drop of the reservoir fluid mixture conducted therethrough and to reduce a mass flow rate of the reservoir fluid mixture prior to fluidly communicating with the production conduit; and recovering at least the heavy oil from the production conduit.

14. The method of claim 13 wherein the defined ratio is 3:1 or 2:1.

15. The method of claim 13 wherein the length of the second fluid conducting passage is between 10X greater and 50X greater than the first cross-sectional diameter.

16. The method of claim 13 further comprising a step of conducting the reservoir fluid from the first fluid conducting passage adjacent one end of a transition passage and the second fluid conducting passage adjacent the other end, the one end of the transition passage having substantially the same cross-sectional flow area as that of the first fluid conducting passage and the other end of the transition passage having substantially the same cross-sectional flow area as that of the second fluid conducting passage.

17. The method of claim 16 wherein the transition passage extends from the one end to the other end at an angle between 0.5 degrees and 30 degrees relative to the first fluid conducting passage's central longitudinal axis.

18. The method of claim 13 wherein the first cross-sectional diameter is in the range between 2 mm and 5 mm.

19. The method of claim 13 wherein the first fluid conducting passage has a length in the range between 7 mm and 10 mm.

20. The method of claim 13 wherein the method is used in steam assisted gravity drainage operations.

21. The method of claim 13, wherein the length of the second fluid conducting passage is between 20X greater and 50X greater than the first cross-sectional diameter.

22. The method of claim 13, wherein the length of the second fluid conducting passage is between 10X greater and 20X greater than the first cross-sectional diameter.

23. The method of claim 13, wherein the first fluid conducting passage and the second fluid conducting passage establish a fluid circuit that is at least partially separate from and substantially parallel to a flow of fluids within the production conduit.

* * * * *